US007770945B2

(12) United States Patent
Umino

(10) Patent No.: US 7,770,945 B2
(45) Date of Patent: Aug. 10, 2010

(54) DOOR LOCK SYSTEM

(75) Inventor: Masaaki Umino, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/743,512

(22) Filed: May 2, 2007

(65) Prior Publication Data

US 2007/0283734 A1 Dec. 13, 2007

Related U.S. Application Data

(62) Division of application No. 11/092,875, filed on Mar. 30, 2005, now Pat. No. 7,621,571.

(30) Foreign Application Priority Data

Mar. 30, 2004 (JP) ..... 2004-99776
Mar. 30, 2004 (JP) ..... 2004-99777
Mar. 30, 2004 (JP) ..... 2004-99778

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 2,477,063 A * 7/1949 Jacobi ..... 74/579 R
4,508,379 A 4/1985 Mochida
4,575,138 A 3/1986 Nakamura et al.
4,735,447 A * 4/1988 Kleefeldt ..... 292/216
4,913,477 A 4/1990 Watanuki et al.
4,948,183 A 8/1990 Yamada
4,974,886 A 12/1990 Kleefeldt et al.
4,986,098 A 1/1991 Fisher
5,000,495 A 3/1991 Wolfgang et al.
5,186,504 A 2/1993 Takaishi et al.
5,350,206 A 9/1994 Akahori et al.
5,419,597 A 5/1995 Brackmann et al.
5,564,761 A 10/1996 Mizuki et al.
5,678,869 A 10/1997 Yoshikuwa
5,709,420 A * 1/1998 Umino ..... 292/216
5,715,713 A 2/1998 Aubry et al.
5,762,384 A * 6/1998 Bartel ..... 292/216
5,833,282 A * 11/1998 Ikeda ..... 292/201
5,992,194 A 11/1999 Baukholt et al.
6,079,757 A * 6/2000 Aubry ..... 292/201
6,109,674 A * 8/2000 Bartel et al. ..... 292/337
6,168,216 B1 * 1/2001 Nakajima et al. ..... 292/201
6,264,253 B1 7/2001 Takaishi
6,371,537 B1 4/2002 Vige et al.

(Continued)

FOREIGN PATENT DOCUMENTS

DE 695 06 959 T2 1/1996

(Continued)

*Primary Examiner*—Carlos Lugo
(74) *Attorney, Agent, or Firm*—Sughrue Mion, PLLC

(57) ABSTRACT

An input shaft of a key lever that transmits a rotating drive force from a key cylinder in response to a key operation is arranged in a lower side of a door housing so that the rain water and the like does not easily reach the input shaft.

1 Claim, 22 Drawing Sheets

U.S. PATENT DOCUMENTS

| | | | | |
|---|---|---|---|---|
| 6,378,920 | B1 | 4/2002 | Ostrowski | |
| 6,428,059 | B2 | 8/2002 | Kobayashi et al. | |
| 6,435,573 | B1 * | 8/2002 | Szablewski | 292/201 |
| 6,497,436 | B1 | 12/2002 | DeBlock et al. | |
| 6,608,265 | B2 * | 8/2003 | Shinkawa | 200/61.64 |
| 6,634,682 | B2 | 10/2003 | Fukunaga et al. | |
| 6,659,515 | B2 | 12/2003 | Raymond et al. | |
| 6,848,727 | B1 | 2/2005 | Cetnar et al. | |
| 6,938,446 | B2 * | 9/2005 | Fukunaga et al. | 70/237 |
| 7,014,228 | B2 | 3/2006 | Hirai | |
| 7,055,872 | B2 | 6/2006 | Hayakawa et al. | |
| 7,063,360 | B2 * | 6/2006 | Fukunaga et al. | 292/216 |
| 7,111,893 | B2 | 9/2006 | Carter et al. | |
| 7,228,610 | B2 | 6/2007 | Carter et al. | |
| 7,243,961 | B2 * | 7/2007 | Fukunaga et al. | 292/216 |
| 7,264,283 | B2 | 9/2007 | Stoof et al. | |
| 2006/0214467 | A1 * | 9/2006 | Usuzaki et al. | 296/146.1 |

FOREIGN PATENT DOCUMENTS

| | | | |
|---|---|---|---|
| DE | 10 20004 022 133 | A1 | 12/2004 |
| EP | 0 743 413 | A1 | 11/1996 |
| EP | 0 784 140 | A1 | 7/1997 |
| EP | 0 894 924 | A1 | 2/1999 |
| GB | 2 301 143 | A | 11/1996 |
| GB | 2 360 324 | A | 9/2001 |
| GB | 2 360 326 | A | 9/2001 |
| JP | 58-033679 | A | 2/1983 |
| JP | 61-49471 | B2 | 10/1986 |
| JP | 1-012775 | A | 5/1989 |
| JP | 02-030871 | A | 2/1990 |
| JP | 02-091373 | A | 3/1990 |
| JP | 5-035419 | U | 5/1993 |
| JP | 09-207717 | A | 8/1997 |
| JP | 11-107597 | A | 4/1999 |
| JP | 2000-064687 | A | 2/2000 |
| JP | 2001-511860 | A | 8/2001 |
| JP | 2001-262902 | A | 9/2001 |
| JP | 2001-262903 | A | 9/2001 |
| JP | 2002-129811 | A | 5/2002 |
| JP | 2003-184393 | A | 7/2003 |
| JP | 2004-197377 | A | 7/2004 |

* cited by examiner

DOOR LOCK SYSTEM

This is a divisional of application Ser. No. 11/092,875 filed Mar. 30, 2005 now U.S. Pat. No. 7,621,571. The entire disclosure(s) of the prior application(s), application Ser. No. 11/092,875 is considered part of the disclosure of the accompanying divisional application and is hereby incorporated by reference.

BACKGROUND OF THE INVENTION

1) Field of the Invention

The present invention relates to a door lock system for vehicles and has a lock mechanism housed in a housing and switches the lock mechanism between an unlocked state and a locked state by a driving force from the outside of this housing.

2) Description of the Related Art

In cars, a door lock system is generally provided between an outside handle and an inside handle provided in a door and a latch mechanism. The latch mechanism has a latch and a ratchet. When the door is closed, the latch mechanism engages with a striker on the vehicle main body side via the latch and the ratchet maintains the engagement between the latch and the striker to maintain the closed state of the door to the vehicle main body. The door lock system has a lock mechanism that is switched between an unlocked state and a locked state due to operation with a key of a key cylinder provided on the outdoor side of the door or operations on an inside lock button provided on the indoor side of the door. The lock mechanism and the key cylinder are linked to each other and the lock mechanism and the inside lock button are linked to each other by link units such as links or wires.

When the lock mechanism is unlocked, this door lock system enables and transmits a door opening operation of the outside handle or the inside handle to the ratchet, and when the ratchet engages with the latch, the lock mechanism releases the engagement of the ratchet with the latch. As a result, the engaged state between the latch and the striker is also released, and it becomes possible to open the door. On the other hand, the door lock system disables at least a door opening operation of the outside handle and does not transmit it to the ratchet when the lock mechanism is locked. As a result, the latch and the striker are maintained in their engaged state even when the outside handle is operated, and it becomes possible to lock the vehicle.

Conventionally, a door lock system is known that houses a latch mechanism in a first housing (latch mechanism housing) and has a lock mechanism housed in a second housing (lock mechanism housing) and assembles the first housing and the second housing to the door while they are assembled and integrated. On the upper portion of this conventional door lock system, a key lever which the front end of a rod projecting from the key cylinder fits in a torque transmittable manner is arranged. The conventional door lock system has seizing units in both housings, in which a guide projection is provided on either one of the housings, a guide groove that fits the guide projection is provided in the other housing, and the guide projection and the guide groove engages with each other to prevent coming out (for example, Japanese Published Unexamined Patent Application No. 2002-129811).

On the other hand, a door lock system is known that has a courtesy switch that comes into abrasive contact with a cam surface formed on the outer circumferential surface of the latch and outputs a signal when the latch is opened or switched from a half-latching state to a full-latching state (for example, Japanese Published Examined Patent Application No. S61-49471). According to this door lock system, when the latch is opened or switched from a half-latching state to a full-latching state, the door is judged as closed and an indoor lamp provided inside the vehicle is turned off, and when the latch is opened or half-latched, the door is judged as half-shut or opened and the indoor lamp provided inside the vehicle is turned on.

However, with conventional door lock systems, the key lever is disposed on the upper side, so that rain water or the like adhering to the key cylinder or a window glass of the door reaches the key lever through the rod and enters into the door lock system. The rain water reaches the mechanisms of the door lock system positioned lower than the key lever and causes the mechanisms to malfunction.

In the conventional door lock system, the guide groove is a member that the guide projection fits in a slidable manner. Moreover, the seizing unit is formed by providing a seizing shaft in the second housing and a seizing groove that fits the seizing shaft in the first housing. The seizing groove includes an engaging hole that fits the seizing shaft and a narrowed portion having a width slightly smaller than the diameter of the seizing shaft. Namely, the guide projection is slid and fit to the guide groove and the seizing groove is fit to the seizing shaft in the diameter direction, whereby the first housing and the second housing are integrated so as not to come out of each other. However, when the seizing groove is fitted to the seizing shaft, it is required that the narrowed portion of the seizing groove is strongly pushed so as to pass over the diameter of the seizing shaft to fit the engaging hole to the seizing shaft. As a result, the assembly for integrating the first housing and the second housing requires a strong force, and this leads to low efficiency in assembly.

Moreover, in the door lock system that is attached to a door while the latch mechanism housing which houses a latch mechanism and the lock mechanism housing which houses a lock mechanism are assembled and integrated, a signal cable connected to a courtesy switch must be wired outside the door lock system from the inside of the latch mechanism housing, so that signal cable wiring is difficult.

SUMMARY OF THE INVENTION

It is an object of the present invention to at least solve the problems in the conventional technology.

According to an aspect of the present invention, a door lock system includes a housing that houses a lock mechanism that can be switched between any one of an unlocked state and a locked state; a handle capable of moving between an open position and a close position, wherein the handle is connected to the lock mechanism via an input mechanism to transmit movement of the handle to the lock mechanism, wherein when the handle is in the open position the lock mechanism is switched through the input mechanism to the unlocked state and when the handle is in the close position the lock mechanism is switched through the input mechanism to the locked state. The input mechanism is arranged at a lower position in the housing.

According to another aspect of the present invention, a door lock system is formed by assembling a latch mechanism housing that houses a latch mechanism that maintains a closed state of a door to a main body of a vehicle and enables the door to be opened with respect to the main body in response to an operation on a handle, and a lock mechanism housing that houses a lock mechanism that switches to an unlocked state when a door opening operation is performed on the handle and that switches to a locked state when a door closing operation is performed on the handle. The door lock system includes a positioning unit that includes a shaft provided and extended in one of the two housings and a concave portion in which the shaft is inserted and fitted along the extending direction of the shaft, provided in other one of the two housings, and fits the positions of the latch mechanism and the lock mechanism by inserting and fitting the shaft into the concave portion; and a restricting unit that restricts relative movements of the latch mechanism housing and the lock mechanism housing in directions other than the extending direction of the shaft when the shaft is inserted and fitted into the concave portion.

According to another aspect of the present invention, a door lock system for attaching to a door of a vehicle includes a latch mechanism housing that houses a latch mechanism that maintains a closed state of the door to a main body of the vehicle and enables the door to be opened with respect to the main body in response to an operation on a handle, and a lock mechanism housing that houses a lock mechanism that switches to an unlocked state when a door opening operation is performed on the handle and that switches to a locked state when a door closing operation is performed on the handle. A signal cable that is connected to a courtesy switch and comes into abrasive contact with a cam surface formed on a latch to detect the latch position is extended from the inside of the latch mechanism housing and nipped and held between the latch mechanism housing and the lock mechanism housing.

The other objects, features, and advantages of the present invention are specifically set forth in or will become apparent from the following detailed description of the invention when read in conjunction with the accompanying drawings.

DETAILED DESCRIPTION

Figure 1:
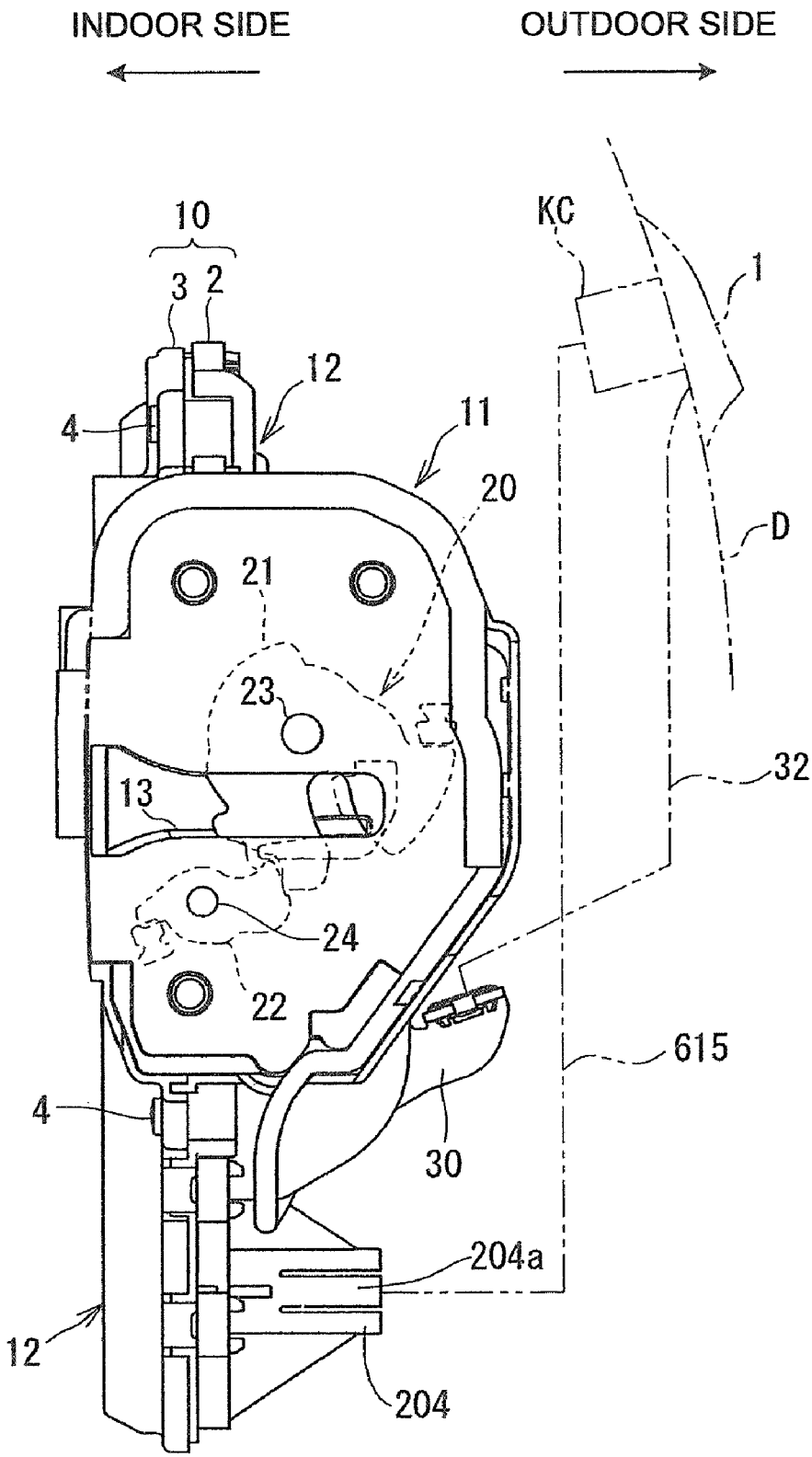
FIG. 1 is a view of a door lock system from the back side of a vehicle according to a first embodiment of the present invention.

Exemplary embodiments of the present invention are explained below with respect to accompanying drawings.

A door lock system according to a first embodiment of the present invention is shown in FIG. 1 to FIG. 4. The door lock system is provided between an outside handle 1 and a latch mechanism 20 in a side door (in the case of a vehicle with a right-hand steering wheel, the door D nearest to the driver's seat) of the front hinge arranged on the front seat right side of the vehicle, and has a main case 2 and a sub case 3. The main case 2 and the sub case 3 are formed from, for example, a synthetic resin, and these are joined to each other and fastened by a fastening unit 4 such as screws to form a housing 10.

Figure 4:
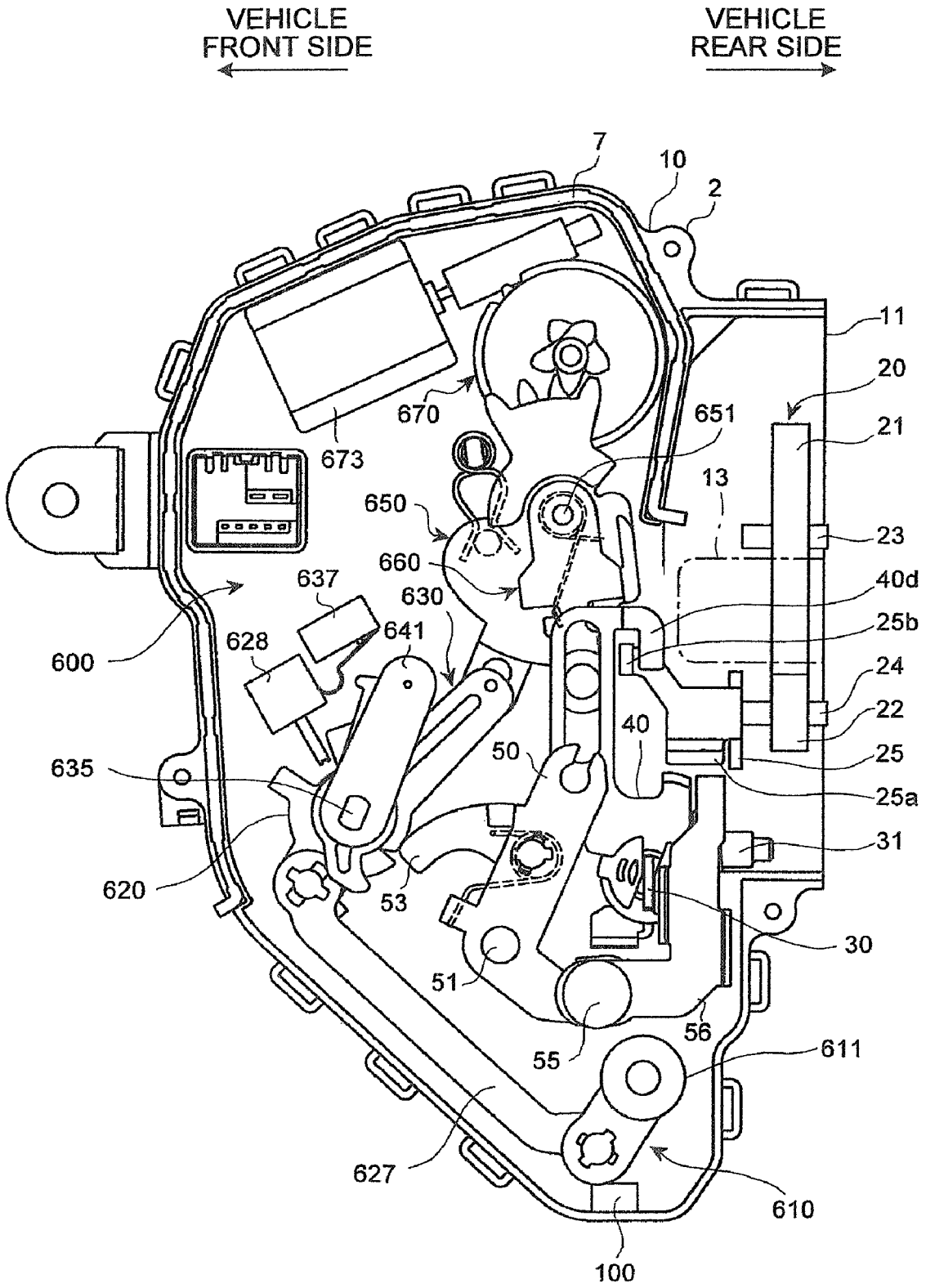
FIG. 4 is a view of the door lock system shown in FIG. 1 from the indoor side after removing a sub case.

The housing 10 formed by the main case 2 and the sub case 3 includes a latch mechanism housing 11 extended along the indoor and outdoor directions of the door D and a lock mechanism housing 12 extended along the front and rear direction of the door D from the indoor side end of the latch mechanism housing 11, and is roughly shaped into an L when viewed from above. As shown in FIG. 4, in the section from the vehicle front side to the vehicle rear side through the vehicle upper side on the joined surface between the main case 2 and the sub case 3, a packing member 7 is interposed to maintain desired watertightness.

The latch mechanism housing 11 has a horizontally notched groove 13 extending horizontally from the indoor side toward the outdoor side at almost the center position in the height direction, and houses the latch mechanism 20 inside.

Figure 5A:
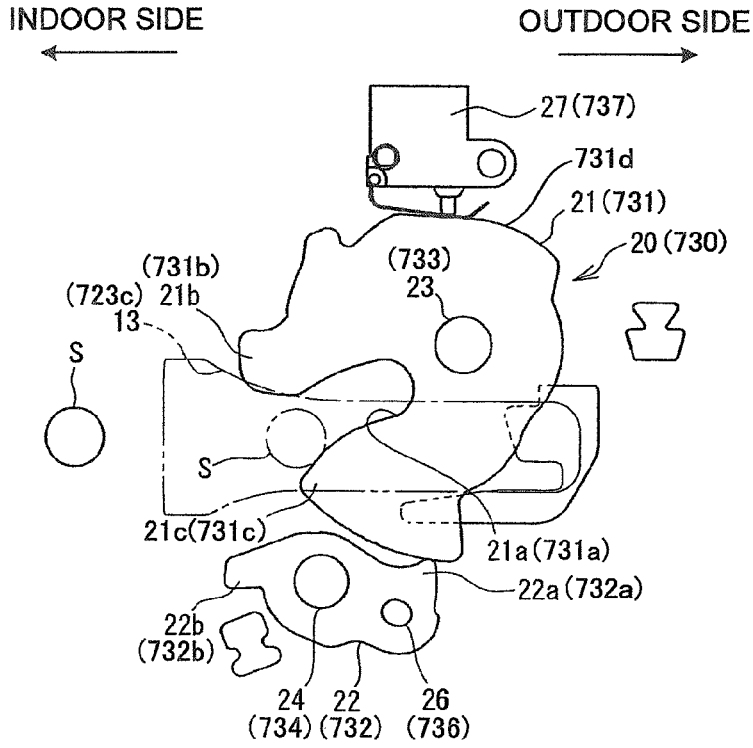
FIG. 5A is a schematic of a latch mechanism in an opening state.
Figure 5B:
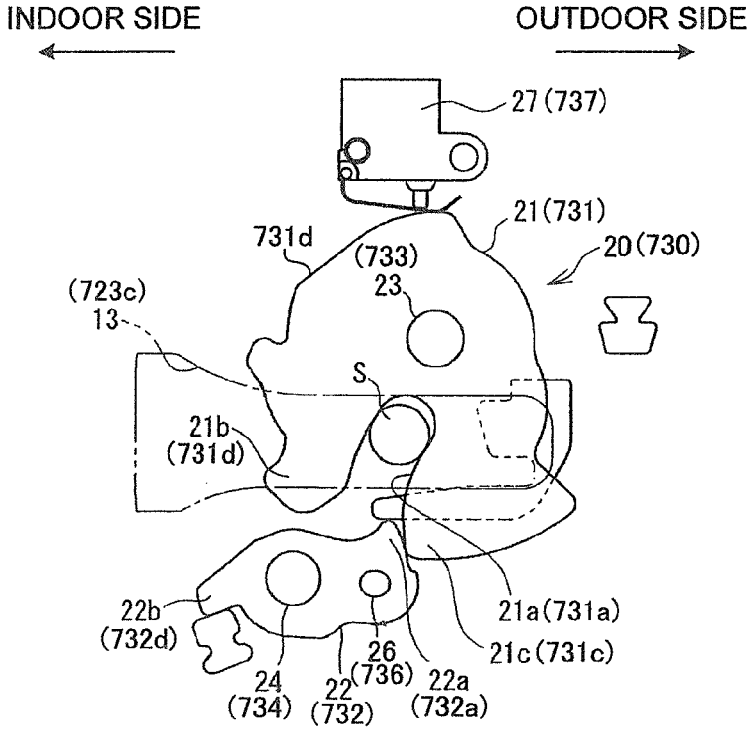
FIG. 5B is a schematic of the latch mechanism in a half-latching state.
Figure 5C:
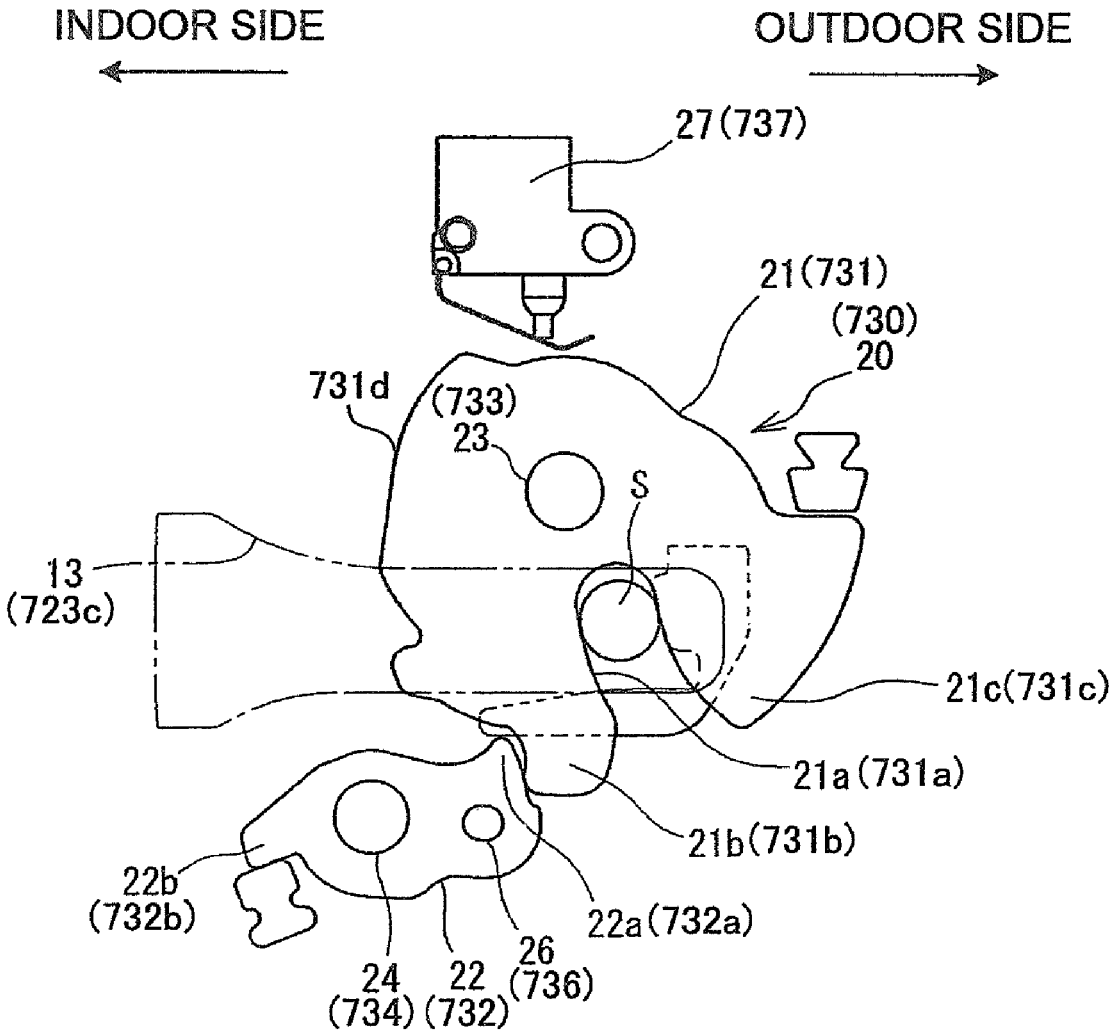
FIG. 5C is a schematic of the latch mechanism in a full-latching state.

The latch mechanism 20 is for engaging with and retaining a striker S provided on the vehicle main body side of the vehicle like a conventional one, and includes a latch 21 and a ratchet 22 as shown in FIGS. 5A to 5C.

The latch 21 is rotatably arranged higher than the horizontally notched groove 13 in the latch mechanism housing 11 via a latch shaft 23 extending almost horizontally along the front and rear direction of the vehicle main body. The latch 21 has an engaging groove 21*a*, a hook 21*b*, and a seizing portion 21*c*.

The engaging groove 21*a* of the latch 21 is opened from the outer circumferential surface of the latch 21 toward the latch shaft 23. The engaging groove 21*a* is formed into a width that houses the striker S.

The hook 21*b* of the latch 21 is positioned on the more indoor side than the engaging groove 21*a* when the engaging groove 21*a* is opened downward. The hook 21*b* stops at a position (opening position) at which the latch 21 opens the horizontally notched groove 13 when it is rotated clockwise around the latch shaft 23 as shown in FIG. 5A. On the other hand, when the latch 21 is rotated counterclockwise around the latch shaft 23, the hook 21*b* stops at a position across the horizontally notched groove 13 as shown in FIG. 5C (latching position) or stops at a position across the horizontally notched groove 13 as shown in FIG. 5B (half-latching position).

The seizing portion 21*c* of the latch 21 is positioned on the more indoor side than the engaging groove 21*a* when the engaging groove 21*a* is opened downward. When the latch 21 is rotated clockwise around the latch shaft 23, the seizing portion 21*c* stops across the horizontally notched groove 13 while inclining gradually upward to the deep side (outdoor side) of the horizontally notched groove 13 as shown in FIG. 5A. Between the latch 21 and the latch mechanism housing 11, a latch spring (not shown) is provided that always presses the latch 21 clockwise around the latch shaft 23.

The ratchet 22 is rotatably arranged lower than the horizontally notched groove 13 of the latch mechanism housing 11 and more indoors than the latch shaft via a ratchet shaft 24 extending roughly horizontally in the front and rear direction of the vehicle main body. The ratchet 22 has an engaging portion 22*a* and an acting portion 22*b*.

The engaging portion 22*a* of the ratchet 22 extends away from the center of the ratchet shaft 24 toward the outdoor side. When the ratchet 22 rotates counterclockwise as shown in FIGS. 5B, the engaging portion 22*a* is capable of engaging with the hook 21*b* and the seizing portion 21*c* of the latch 21 via the projecting end face. The acting portion 22*b* of the ratchet 22 extends away from the center of the ratchet shaft 24 toward the indoor side.

As shown in FIG. 4, the ratchet 22 has a ratchet lever 25. The ratchet lever 25 rotates around the ratchet shaft 24 integrally with the ratchet 22 at a position on the vehicle front side. The ratchet lever 25 has a contact portion 25*a* formed so as to extend in the same direction as that of the acting portion 22*b* of the ratchet 22 from the ratchet shaft 24, bend to the vehicle front side (lock mechanism housing 12 side), and bend at its lower region to the vehicle indoor side, and a working end 25*b* formed so as to extend upward of the vehicle front side from the contact portion 25*a* and bend to the vehicle indoor side. This ratchet lever 25 is joined to the ratchet 22 by a joint pin 26 as shown in FIG. 5A. Between the ratchet 22 and the latch mechanism housing 11, a ratchet spring (not shown) is provided that always presses the ratchet 22 counterclockwise around the ratchet shaft 24.

In the latch mechanism 20, a courtesy switch 27 that detects the position of the latch 21 is arranged above the latch 21. The armature of the courtesy switch 27 detects that the latch 21 is at a latching position by coming into abrasive contact with the outer circumferential surface of the latch 21 and separating from the outer circumferential surface of the latch 21, and turns an indoor lamp (not shown) of the vehicle on when the latch 21 is at a position (for example, an opening position or a half-latching position) outside of the latching position.

In the latch mechanism 20, when the door D is opened from the vehicle main body, as shown in FIG. 5A, the latch 21 is arranged at an opening position, and the indoor lamp of the vehicle is turned on. When the door D is operated to close from this state, the striker S provided on the vehicle main body side enters the horizontally notched groove 13 of the latch mechanism housing 11 and the striker S eventually comes into contact with the seizing portion 21*c* of the latch 21. As a result, the latch 21 rotates counterclockwise around the latch shaft 23 in FIGS. 5A to 5C against an elastic force of a latch spring (not shown). During this rotation, the projecting end of the engaging portion 22*a* of the ratchet 22 comes into abrasive contact with the outer circumferential surface of the latch 21 due to an elastic force of a ratchet spring (not shown), and the ratchet rotates around the ratchet shaft 24 according to the outer circumferential form of the latch 21.

When the door D is operated to close from the state described above, as shown in FIG. 5B, the entering amount of the striker S to the horizontally notched groove 13 gradually increases, so that the latch 21 further rotates counterclockwise, and the engaging portion 22*a* of the ratchet 22 reaches the engaging groove 21*a* of the latch 21. In this state, the seizing portion 21*c* of the latch 21 comes into contact with the engaging portion 22*a* of the ratchet 22, so that the clockwise rotation of the latch 21 is blocked against the elastic returning force of the latch spring (not shown). In addition, since the hook 21*b* of the latch 21 is arranged across the horizontally notched groove 13, the situation that the striker S comes out of the horizontally notched groove 13, that is, the opening operation of the door D from the vehicle main body is prevented by the hook 21*b* (half-latching state).

When the door D is operated further to close from the half-latching state, as shown in FIG. 5C, due to the striker S entering the horizontally notched groove 13, the latch 21 rotates further counterclockwise around the latch shaft 23 via the seizing portion 21*c*, and the striker S reaches the deep side (outdoor side) of the horizontally notched groove 13. During this time, the ratchet 22 rotates clockwise around the ratchet shaft 24 in FIGS. 5A to 5C against the elastic force of the ratchet spring (not shown) by contact of the hook 21*b* of the latch 21 to the upper surface of the engaging portion 22*a*, and immediately after the hook 21*b* of the latch 21 passes over, the ratchet starts rotating counterclockwise due to the elastic returning force of the ratchet spring (not shown). As a result, as shown in FIG. 5C, since the hook 21*b* of the latch 21 comes into contact with the engaging portion 22*a* of the ratchet 22, the clockwise rotation of the latch 21 is blocked against the elastic returning force of the latch spring (not shown). In this state, since the hook 21*b* of the latch 21 is arranged across the horizontally notched groove 13, the situation that the striker S comes out of the deep side (outdoor side) of the horizontally notched groove 13 is prevented by the hook 21*b*, and as a result, the door D is maintained in a closed state from the vehicle main body (full-latching state), and the indoor lamp of the vehicle is turned off.

Figure 6A:
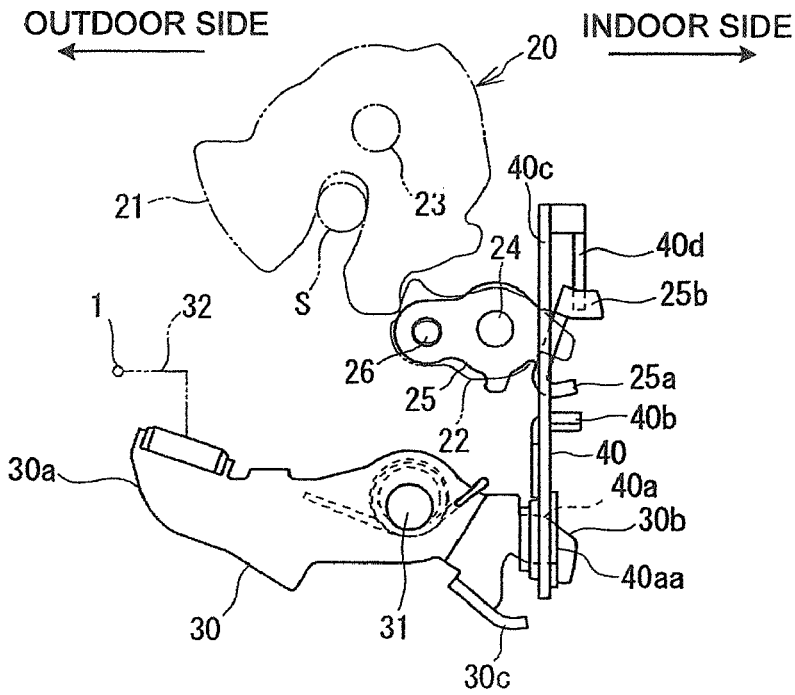
FIG. 6A is a schematic of the relationship between an open lever and a link lever in an initial state.
Figure 6B:
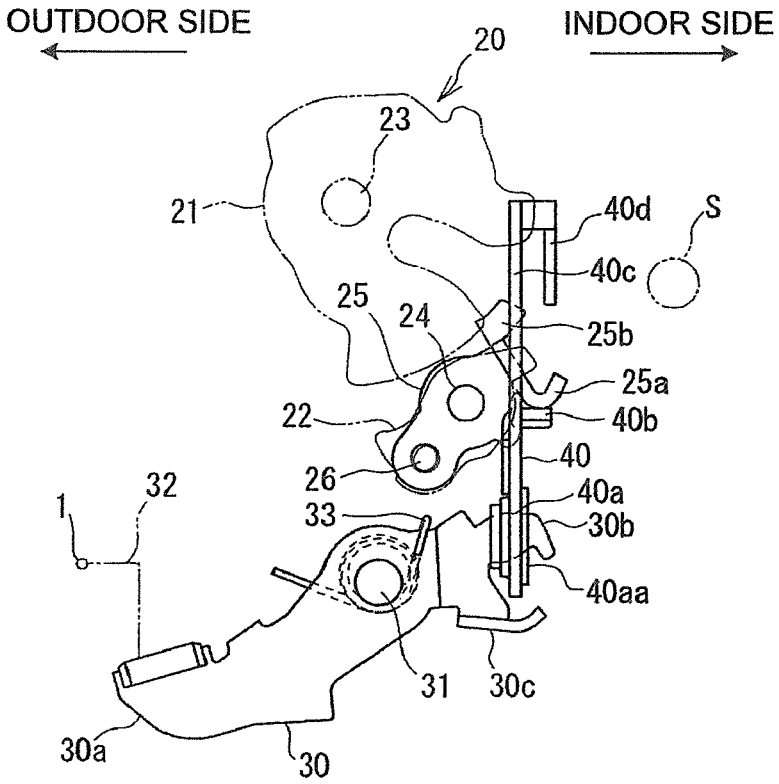
FIG. 6B is a schematic of the relationship between the open lever and the link lever when the outside handle is operated to open the door.

When the acting portion 22*b* of the ratchet 22 or the contact portion 25*a* of the ratchet lever 25 is rotated clockwise around the ratchet shaft 24 in FIGS. 5A to 5C against the elastic force of the ratchet spring (not shown) from the full-latching state, the contact engagement between the hook 21*b* of the latch 21 and the engaging portion 22*a* of the ratchet 22 is released and the latch 21 rotates clockwise in FIGS. 6A and 6B due to the elastic returning force of the latch spring (not shown). As a result, as shown in FIG. 5A, the horizontally notched groove 13 is opened, the striker S becomes movable in the direction of coming out of the horizontally notched groove 13 and the door D becomes capable of being opened from the vehicle main body, and the indoor lamp of the vehicle is turned on.

On the other hand, the lock mechanism housing 12 houses, as shown in FIG. 1 through FIG. 4, an open lever 30, a link lever 40, an inner handle lever 50, and a lock mechanism 600.

The open lever 30 is rotatably arranged via an open lever shaft 31 extending almost horizontally along the front and rear direction of the vehicle main body at a position lower than the ratchet 22 of the latch mechanism 20 as shown in FIGS. 6A and 6B, and has an open acting end 30*a*, an open working end 30*b*, and a pressure receiver 30*c*.

The open acting end 30*a* of the open lever 30 extends away from the center of the open lever shaft 31 and toward the outdoor side and outside of the housing 10. An outside handle link unit 32, such as a link that links to the outside handle 1 provided on the door D, is connected to the portion of the open acting end 30*a* that projects outside of the housing 10. The outside handle link unit 32 is connected in such a manner that the open lever 30 rotates counterclockwise around the open lever shaft 31 in FIGS. 6A and 6B when the outside handle 1 is operated to open the door.

The open working end 30*b* of the open lever 30 extends away from the center of the open lever shaft 31 as shown in FIGS. 6A and 6B, and the extending end is positioned below the contact portion 25*a* on the ratchet lever 25 inside the housing 10.

The pressure receiver 30*c* of the open lever 30 is positioned below the open working end 30*b*, and is bent forward from the lower edge of the open lever 30. Between the open lever 30 and the lock mechanism housing 12, an open lever spring 33 is provided that always presses the open lever 30 clockwise around the open lever shaft 31.

To the open working end 30*b* of the open lever 30, a link lever 40 is attached. The link lever 40 has an attaching hole 40*a* on its base end as shown in FIGS. 6A, 6B, 7A, and 7B. This attaching hole 40*a* is formed in a rotor 40*aa* provided so as to rotate around the center of the axis along the indoor and outdoor direction of the vehicle main body with respect to the link lever 40. By inserting the open working end 30*b* of the open lever 30 through the attaching hole 40*a*, the link lever 40 is supported so as to move up and down with this open working end 30*b* and swing around the center of axis along the indoor and outdoor direction of the vehicle main body via the rotor 40*aa* with respect to the open working end 30*b*. This link lever 40 has a ratchet driver 40*b*, a panic lever joint 40*c*, and a lock preventer 40*d*.

The ratchet driver 40*b* of the link lever 40 extends away from the center of the attaching hole 40*a* and toward the contact portion 25*a* of the ratchet lever 25. The ratchet driver 40*b* is provided so as to press the contact portion 25*a* of the ratchet lever 25 in response to upward movement of the link lever 40.

The panic lever joint 40*c* of the link lever 40 extends upward lateral to the side of the working end 25*b* of the ratchet lever 25 from the center of axis of the attaching hole 40*a*. In the extending portion of the panic lever joint 40*c*, a joint slot 40*e* long in the vertical direction is formed.

The lock preventer 40*d* of the link lever 40 is adjacent to the working end 25*b* of the ratchet lever 25 and prevents the link lever 40 from swinging when the latch 21 is at an opening position. The lock preventer 40*d* extends downward to the vehicle rear side from the side of the panic lever joint 40*c*.

Figure 7A:
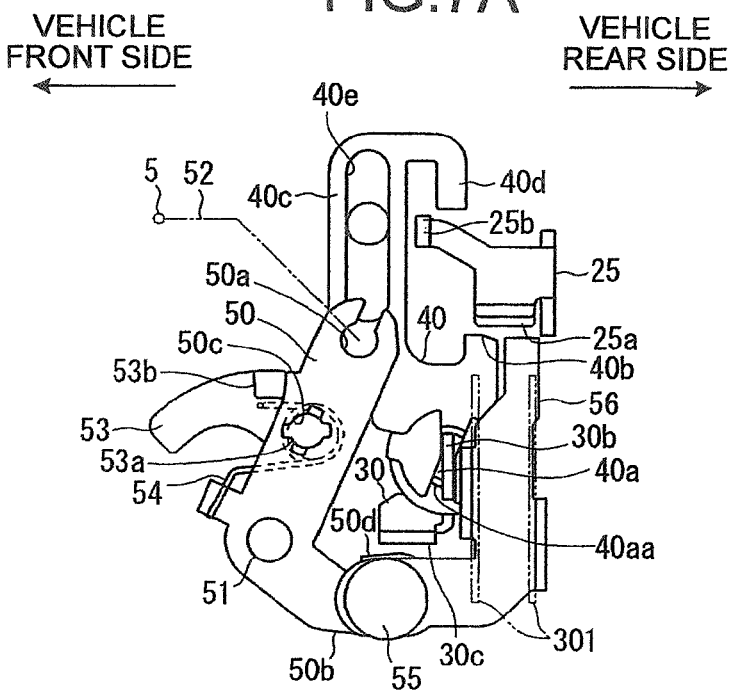
FIG. 7A is a schematic of the relationship between an inner handle lever and the link lever in an initial state.
Figure 7B:
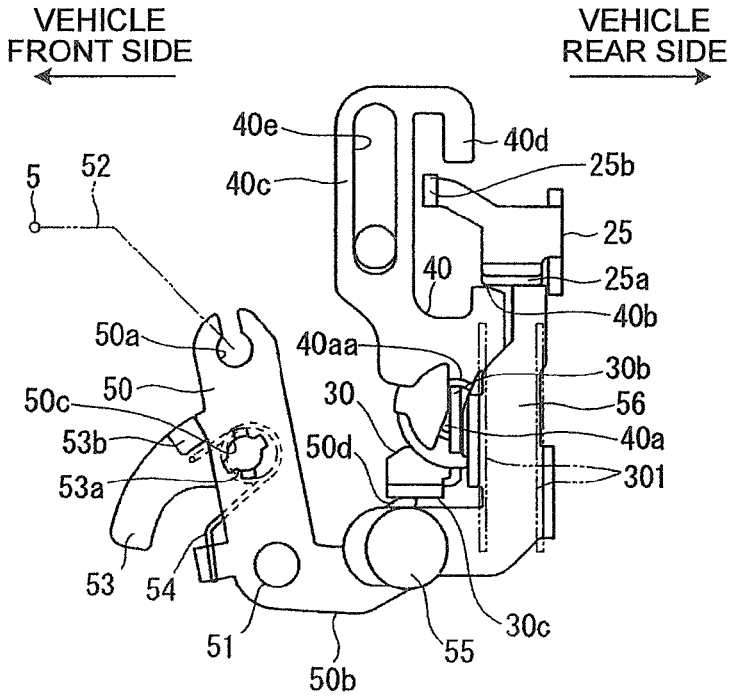
FIG. 7B is a schematic of the relationship between the inner handle lever and the link lever when an inside handle lever is operated to open the door.

The inner handle lever 50 is arranged so as to swing via an inner lever shaft 51 extending almost horizontally along the indoor and outdoor direction of the vehicle main body below the open lever 30 as shown in FIGS. 7A and 7B. The inner handle lever 50 has an inner acting portion 50*a* and a working end 50*b*.

The inner acting portion 50*a* of the inner handle lever 50 extends upward from the inner lever shaft 51, and the extending end projects outward of the housing 10. The portion of the inner acting portion 50*a* projecting outward of the housing 10 is connected to an inside handle link unit 52 such as a link or a wire that links to an inside handle 5 provided on the indoor side of the door D. In detail, the inside handle link unit 52 is connected so that the inner handle lever 50 swings counterclockwise around the inner lever shaft 51 when the inside handle 5 is operated to open the door.

In the middle of extension of the inner acting portion 50*a*, a one-motion lever joint hole 50*c* is formed. In this one-motion lever joint hole 50*c*, a one-motion lever 53 is attached. The one-motion lever 53 is formed so as to extend in an arc shape to the front side of the vehicle from the inner acting portion 50*a* centered on the inner lever shaft 51. At the base end of the one-motion lever 53, a shaft 53*a* and a contact portion 53*b* are formed. The shaft 53*a* is rotatably attached to the one-motion lever link hole 50*c* of the inner acting portion 50*a*. The contact portion 53*b* comes into contact with the side surface of the inner acting portion 50*a*. Between the one-motion lever 53 and the inner acting portion 50*a*, a one-motion spring 54 interposes so that the contact portion 53*b* of the one-motion lever 53 comes into contact with the side surface of the inner acting portion 50*a*.

The working end 50*b* of the inner handle lever 50 extends while inclining downward to the vehicle rear side from the inner lever shaft 51. To the working end 50*b*, a one-motion link 56 is attached via a rivet 55 so as to move upward. On the working end 50*b*, a presser 50*d* that comes into contact with the pressure receiver 30*c* of the open lever 30 and presses this upward when the inner handle lever 50 swings counterclockwise around the inner lever shaft 51 as shown in FIG. 7B is formed by being bent to the outdoor side of the vehicle.

The one-motion link 56 comes into contact with the contact portion 25*a* of the ratchet lever 25 and presses this upward when the inner handle lever 50 swings counterclockwise in FIGS. 7A and 7B around the inner lever shaft 51. The one-motion link 56 has a roughly L shape, and extends toward the vehicle rear side and away from the center of the rivet 55 and extends toward (upward) the contact portion 25*a* of the ratchet lever 25.

At the base end of the one-motion link 56, a link hole (not shown) long in the front and rear direction of the vehicle is formed, and is engaged with the rivet 55 by having play so as to swing. In the sub case 3, along the portion of the one-motion link 56 along the portion extending toward the contact portion 25*a*, as shown by the chain double-dashed line in FIGS. 7A and 7B, guides 301 that guide the portion of the one-motion link 56 extending toward the contact portion 25*a* so as to move vertically are formed.

The lock mechanism 600 switches between an unlocked state in that the lock mechanism transmits the rotation of the open lever 30 in response to a door opening operation on the outside handle 1 to the latch mechanism 20 and a locked state in that the lock mechanism does not transmit the rotation of the open lever 30 in response to a door opening operation on the outside handle 1 to the latch mechanism 20. The lock mechanism 600 has, as shown in FIG. 4, a key lever 610, a key sub lever 620, a connect lever 630, a sector gear 650, a panic lever 660, and a worm wheel 670 on the surface of the main case 2 opposite the sub case 3, that is, the surface of the main case 2 covered by the sub case 3.

Figure 8A:
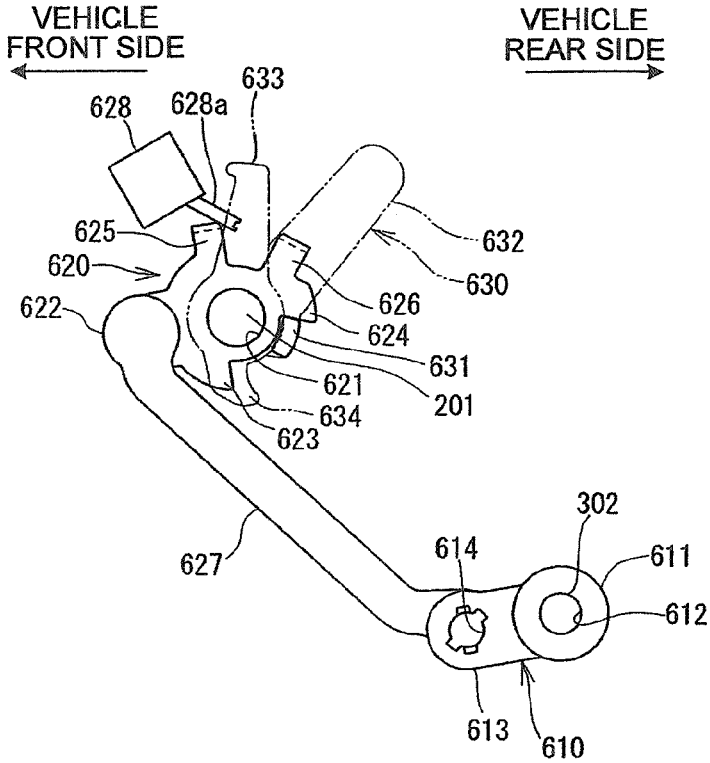
FIG. 8A is a schematic of the lock mechanism when the door is unlocked by a key operation.
Figure 8B:
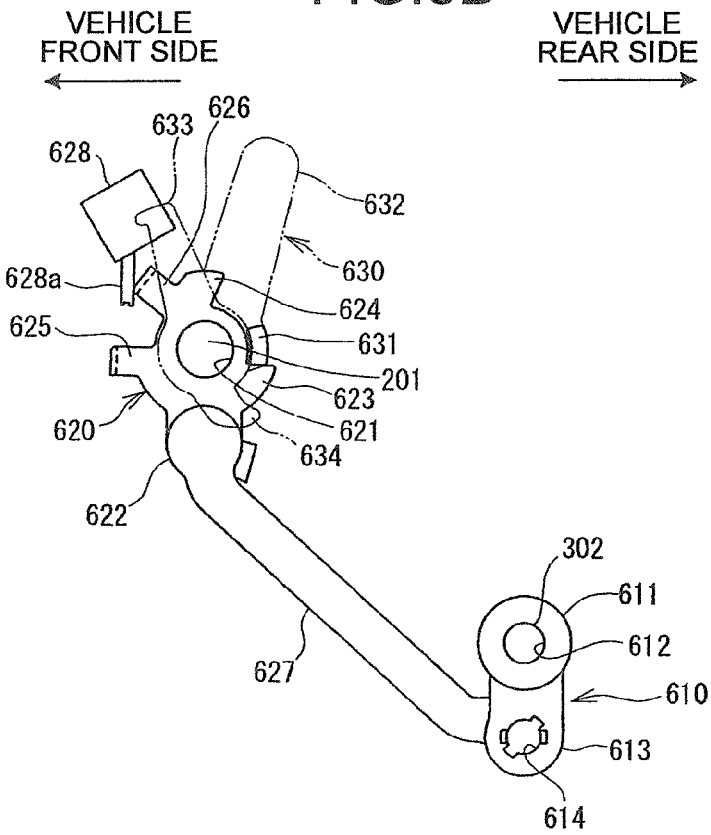
FIG. 8B is a schematic of the lock mechanism when the door is locked by a key operation.

The key lever 610 is rotatably arranged at the lower side of the housing 10. The key lever 610 has an input shaft 611, a rotating concave portion 612, and a lever portion 613 as shown in FIGS. 8A and 8B.

The input shaft 611 of the key lever 610 serves as an input unit that inputs a rotating drive force when the key cylinder KC provided in the door D is key-operated. To the input shaft 611, a key cylinder link unit 615 (see FIG. 1) such as a link or cable that transmits a rotating drive force of the key cylinder KC according to a key operation is connected. In detail, the key cylinder link unit 615 is connected to the input shaft 611 so that when the key cylinder KC is operated to lock the door, the key lever 610 rotates counterclockwise in FIGS. 8A and 8B, and when the key cylinder KC is operated to unlock the door, the key lever 610 rotates clockwise in FIGS. 8A and 8B.

The rotating concave portion 612 of the key lever 610 is formed by being concaved on the input shaft 611. The rotating concave portion 612 supports the key lever 610 in a rotatable manner by fitting a convex portion 302 formed on the sub case 3.

The lever portion 613 of the key lever 610 extends away from the center of the input shaft 611. A key link joint hole 614 is formed on the end of the lever portion 613 that is away from the center of the input shaft 611.

The key sub lever 620 is rotatably arranged at the vehicle front side above the key lever 610 as shown in FIGS. 8A and 8B. The key sub lever 620 has a rotation hole 621, a key link joint 622, a lock switching projection 623, an unlock switching projection 624, a lock operation recognition projection 625, and an unlock operation recognition projection 626.

Through the rotation hole 621 of the key sub lever 620, a convex portion 201 formed and extended inside the housing 10 (the indoor side of the vehicle main body) in the main case 2 is inserted. Thereby, the rotation hole 621 is arranged so that the key sub lever 620 rotates around the convex portion 201 in FIGS. 8A and 8B.

The key link joint 622 of the key sub lever 620 extends away from the center of the axis of the rotation hole 621 (convex portion 201). In the front end of the key link joint 622, a key link joint hole 622*a* (see FIGS. 9A and 9B) is formed. This key link joint hole 622*a* and the key link joint hole 614 of the key lever 610 are joined to each other by the key link 627. Namely, the rotation of the key lever 610 is transmittable to the key sub lever 620 through the key link 627.

The lock switching projection 623 and the unlock switching projection 624 of the key sub lever 620 are formed so as to extend away from the center of the axis of the rotation hole 621. When rotating the key sub lever 620, the lock mechanism 600 is switched from an unlocked state to a locked state by the lock switching projection 623. On the other hand, when rotating the key sub lever 620, the lock mechanism 600 is switched from a locked state to an unlocked state by the unlock switching projection 624.

The lock operation recognition projection 625 and the unlock operation recognition projection 626 of the key sub lever 620 extend away from the center of axis of the rotation hole 621. When the key sub lever 620 is switched from an unlocking state to a locking state, the lock operation recognition projection 625 turns down the detection piece 628*a* of the switch 628 clockwise. On the other hand, when the key sub lever 620 is switched from a locking state to an unlocking state, the unlock operation recognition projection 626 turns down the detection piece 628*a* of the switch 628 counterclockwise. Thus, the lock operation recognition projection 625 and the unlock operation recognition projection 626 operate the detection piece 628*a* of the switch 628 to distinguish a key operation on the key cylinder KC, that is, a lock operation, and an unlock operation.

Figure 9A:
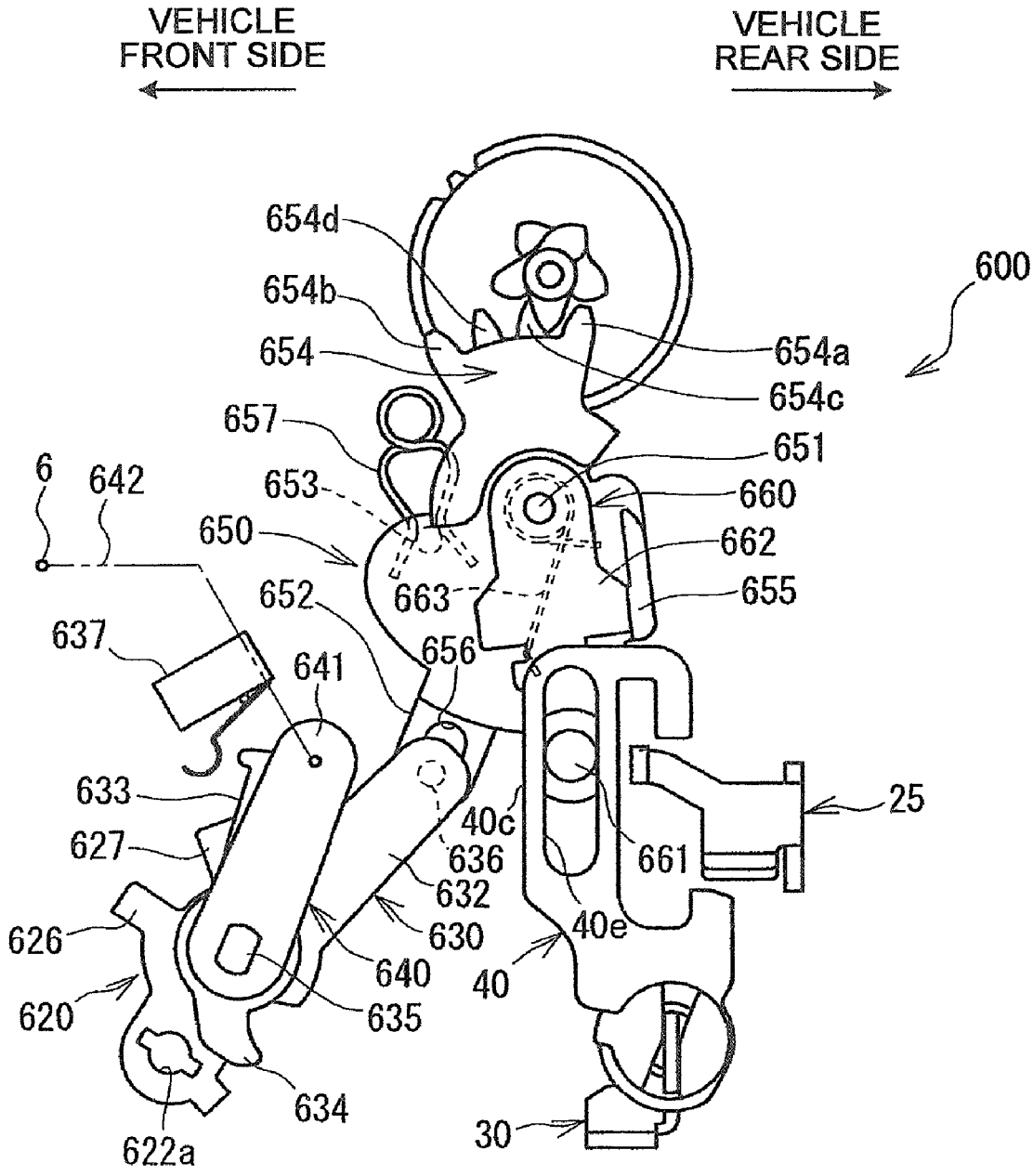
FIG. 9A is a schematic of the lock mechanism when a lock lever is in an unlocking state.

As shown in FIG. 9A, the connect lever 630 is rotatably attached concentrically with the rotation hole 621 of the key sub lever 620. The connect lever 630 includes a switching projection 631, a sector gear joint 632, a switch lever 633, a one-motion projection 634, and a rotation shaft 635.

The switching projection 631 of the connect lever 630 switches the connect lever 630 from an unlocking state to a locking state and from a locking state to an unlocking state. The switching projection 631 is formed on the surface opposite the key sub lever 620. In detail, the switching projection 631 can come into contact with the lock switching projection 623 and the unlock switching projection 624. When the switching projection 631 comes into contact with the lock switching projection 623 and presses the switching projection 631, the connect lever 630 switches from an unlocking state to a locking state. On the other hand, when the switching projection 631 comes into contact with the unlock switching projection 624 and presses the switching projection 631, the connect lever 630 switches from a locking state to an unlocking state.

The sector gear joint 632 of the connect lever 630 extends away from the center of rotation of the connect lever 630. The sector gear joint 632 has a joint convex portion 636 on the extending front end. The joint convex portion 636 extends almost horizontally along the indoor and outdoor direction of the vehicle main body from the surface positioned on the outdoor side at the front end of the sector gear joint 632.

The switch lever 633 of the connect lever 630 is for detecting the position of the connect lever 630. The switch lever 633 turns a switch 637 off when the connect lever 630 is in an unlocking state (see FIG. 9A). On the other hand, the switch lever 633 turns the switch 637 on when the connect lever 630 switches to a locking state (see FIG. 9B).

The one-motion projection 634 of the connect lever 630 comes into contact with the one-motion lever 53 to switch the lock mechanism 600 in a locked state to an unlocked state. The one-motion projection 634 that extends away from the center of rotation of the connect lever 630 so that the one-motion projection is positioned so as to come into contact with the one-motion lever 53 when the lock mechanism 600 is in a locked state, and positioned so as not to be in contact with the one-motion lever 53 when the lock mechanism 600 is in an unlocked state.

The rotation shaft 635 of the connect lever 630 supports the connect lever 630 rotatably with respect to the sub case 3. The rotation shaft 635 extends integrally from the connect lever 630, and the end thereof penetrates the sub case 3 and projects from the housing 10. This rotation shaft 635 is located in the housing 10 below the electrical parts such as the switch 628, the switch 637, and a drive motor 673 described later provided inside the housing 10 as shown in FIG. 4.

A lock lever 640 is fixed to the projecting end of the rotation shaft 635. The lock lever 640 rotates integrally with the connect lever 630. Namely, when the connect lever 630 changes from a locking state to an unlocking state, the lock lever 640 changes from a locking state to an unlocking state, and when the connect lever 630 changes from an unlocking state to a locking state, the lock lever 640 changes from an unlocking state to a locking state. On the other hand, when the lock lever 640 changes from an unlocking state to a locking state, the connect lever 630 changes from an unlocking state to a locking state, and when the lock lever 640 changes from an locking state to a unlocking state, the connect lever 630 changes from a locking state to an unlocking state.

The lock lever 640 has a button joint 641. The button joint 641 is the front end portion of the lock lever 640 extending away from the rotation shaft 635 of the connect lever 630. To this button joint 641, a lock button link unit 642 such as a link or wire that links to an inside lock button 6 provided on the indoor side of the door D is connected. Namely, when the inside lock button 6 is operated to lock the door, the drive force is transmitted to the lock lever 640 through the lock button link unit 642, and the lock lever 640 rotates counterclockwise in FIG. 9A and rotates the rotation shaft 635 counterclockwise. On the other hand, when the inside lock button 6 is operated to unlock the door, the drive force is transmitted to the lock lever 640 through the lock button link unit 642, and the lock lever 640 rotates clockwise in FIG. 9B and rotates the rotation shaft 635 clockwise. Thus, the drive force from the outside of the housing 10, which operated the inside lock button 6, is transmitted to the lock lever 640 through the lock button link unit 642 and inputted into the rotation shaft 635 serving as an input portion. The rotation shaft 635 in which the drive force from the outside of the housing 10 has been inputted switches the lock mechanism 600 between an unlocking state and a locking state.

Figure 9B:
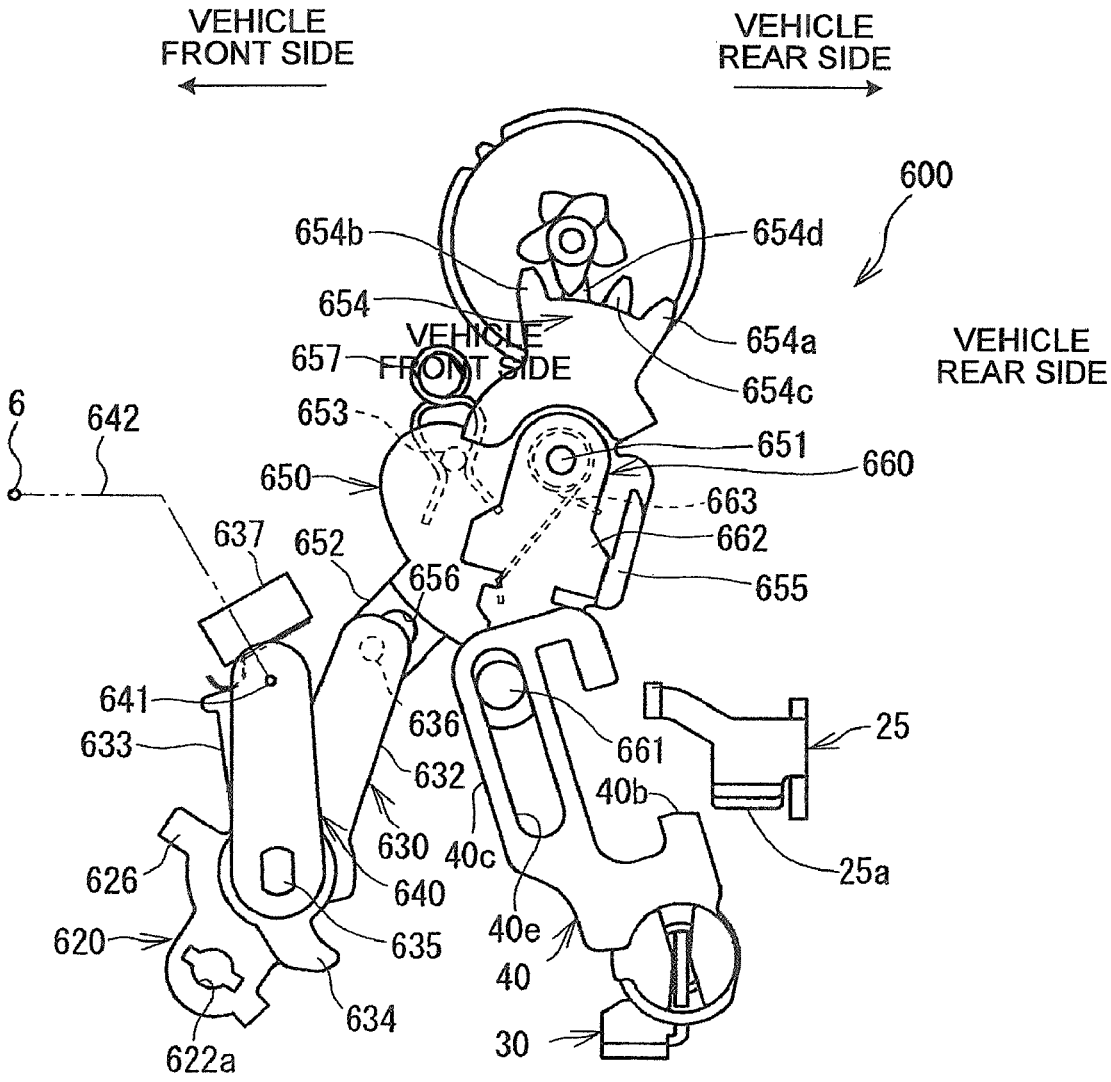
FIG. 9B is a schematic of the lock mechanism when the lock lever is in a locking state.

The sector gear 650 is arranged so as to swing via a gear shaft 651 extending almost horizontally along the indoor and outdoor direction of the vehicle main body as shown in FIGS. 9A and 9B. The sector gear 650 includes a connect lever joint 652, a state maintaining projection 653, a driven gear 654, and a panic lever contact portion 655.

The connect lever joint 652 of the sector gear 650 extends away from the center of the gear shaft 651. In the connect lever joint 652, a joint slot 656 is formed. In this joint slot 656, the joint convex portion 636 formed on the connect lever 630 is inserted. Namely, counterclockwise swinging of the connect lever 630 makes the sector gear 650 to swing clockwise around the gear shaft 651, and on the other hand, clockwise swinging of the connect lever 630 makes the sector gear 650 to swing counterclockwise around the gear shaft 651.

The state maintaining projection 653 of the sector gear 650 maintains the rotating position of the sector gear 650. The state maintaining projection 653 extends almost horizontally along the indoor and outdoor direction of the vehicle main body on the surface opposite the main case 2. By nipping and holding this state maintaining projection 653 by a spring 657 attached to the main case 2, the unlocking state (FIG. 9A) or locking state (FIG. 9B) is maintained.

The driven gear 654 of the sector gear 650 is formed into a fan shape centered on the gear shaft 651 as shown in FIGS. 9A and 9B. The driven gear 654 has, on its outer circumferential surface, a pair of outside teeth 654*a* and 654*b*, a first passive tooth 654*c*, and a second passive tooth 654*d*. The pair of outside teeth 654*a* and 654*b*, the first passive tooth 654*c*, and the second passive tooth 654*d* are provided at three different heights along the extending direction of the gear shaft 651. The pair of outside teeth 654*a* and 654*b* are provided on both sides of the driven gear 654, and arranged at the most indoor side. The first passive tooth 654*c* is located close to one outside tooth 654*a* between the pair of outside teeth 654*a* and 654*b* at the middle position along the extending direction of the gear shaft 651. The second passive tooth 654*d* is situated between the other outside tooth 654*b* and the first passive tooth 654*c*, and positioned at the most outdoor side.

The panic lever contact portion 655 of the sector gear 650 is formed to be convex toward the indoor side from the vehicle rear side edge of the sector gear 650.

The panic lever 660 joins the sector gear 650 and the link lever 40 to each other as shown in FIGS. 9A and 9B. The panic lever 660 is rotatably attached to the gear shaft 651. This panic lever 660 extends downward and away from the center of the gear shaft 651, and provided with a joint convex portion 661 and a sector gear contact portion 662.

The joint convex portion 661 of the panic lever 660 is a columnar portion projecting almost horizontally along the indoor and outdoor direction of the vehicle main body from the surface on the indoor side of the front end of the panic lever 660. This joint convex portion 661 is attached to the joint slot 40*e* of the link lever 40.

The sector gear contact portion 662 of the panic lever 660 is a stepped portion formed on the vehicle rear side in the middle of the panic lever 660. The sector gear contact portion 662 is allowed to come into contact and interlock with the panic lever contact portion 655 of the sector gear 650.

Between the sector gear 650 and the panic lever 660, a panic spring 663 interposes, and is pressed so that the sector gear contact portion 662 of the panic lever 660 comes into contact with the panic lever contact portion 655 of the sector gear 650.

Figure 10A:
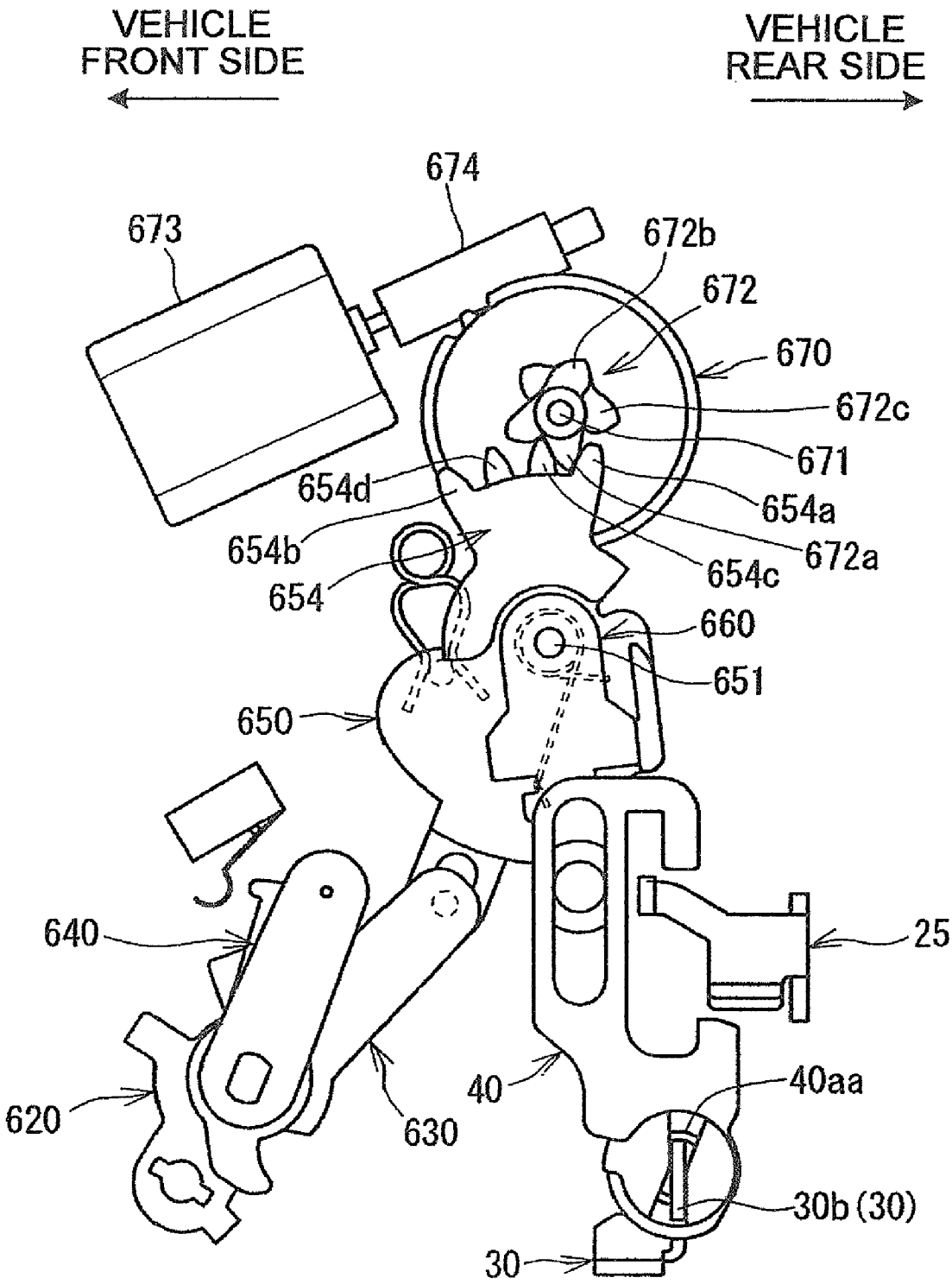
FIG. 10A is a schematic of the lock mechanism in an unlocked state by driving a drive motor.
Figure 10B:
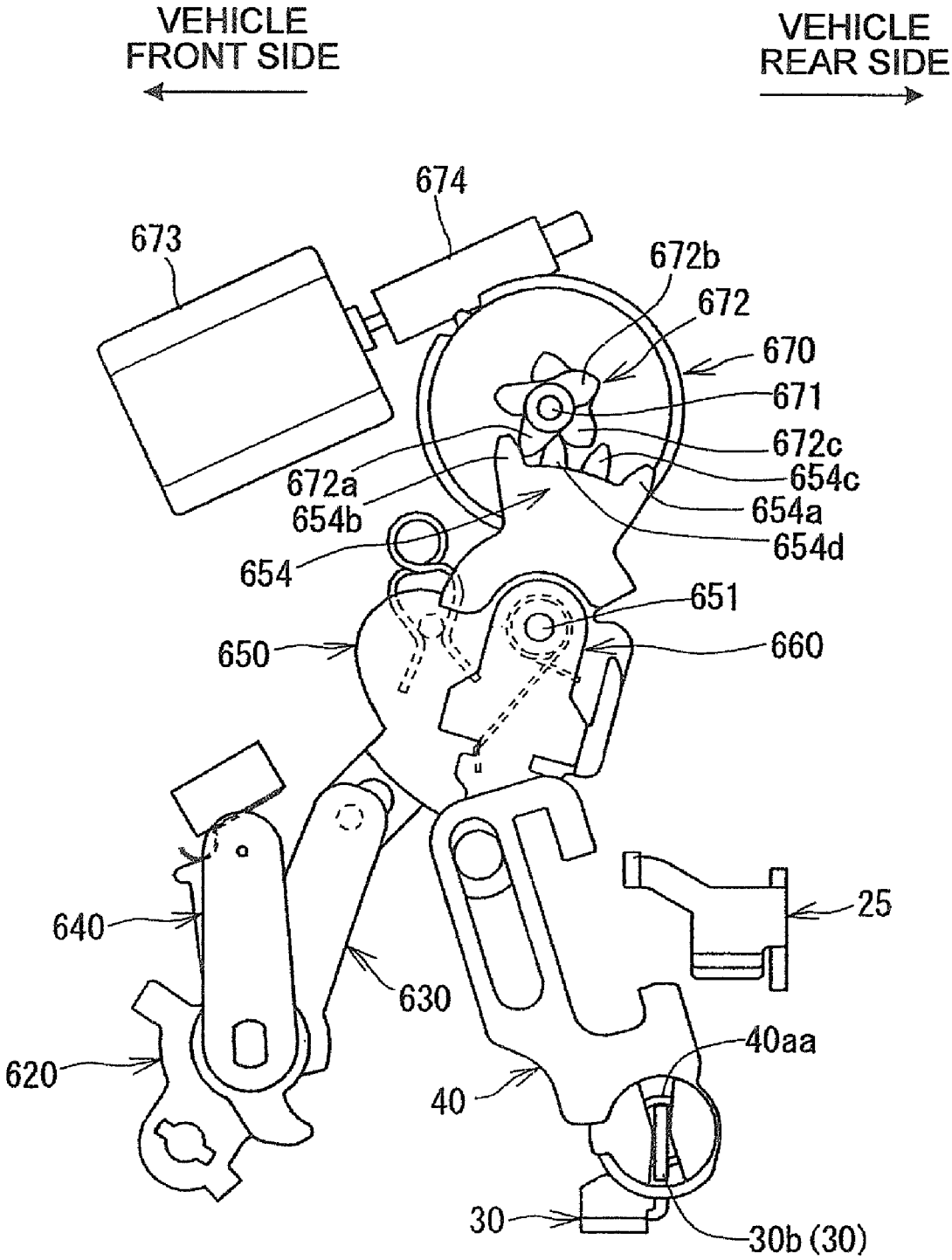
FIG. 10B is a schematic showing the lock mechanism in a locked state by driving the drive motor.

The worm wheel 670 is rotatably arranged as shown in FIGS. 10A and 10B via a worm shaft 671 extending almost horizontally along the indoor and outdoor direction of the vehicle main body above the sector gear 650. To this worm wheel 670, an intermittent gear 672 is fixed concentrically.

The intermittent gear 672 of the worm wheel 670 has a basic tooth 672*a*, a pair of first drive teeth 672*b* and a pair of second drive teeth 672*c*. The intermittent gear 672 forms a one-directional power transmission unit between the worm wheel and the pair of outside teeth 654*a* and 654*b*, the first passive tooth 654*c*, and the second passive tooth 654*d* provided on the driven gear 654 of the sector gear 650. Namely, the basic tooth 672*a*, the pair of first drive teeth 672*b*, and the pair of second drive teeth 672*c* of the intermittent gear 672 are provided at three different heights along the extending direction of the worm shaft 671 like the pair of outside teeth 654*a* and 654*b*, the first passive tooth 654*c*, and the second passive tooth 654*d* of the driven gear 654, and the basic tooth 672*a* engages with only the outside teeth 654*a* and 654*b*, the first drive teeth 672*b* engage With only the first passive tooth 654*c*, and the second drive teeth 672*c* engage with only the second passive tooth 654*d*. Between the worm wheel 670 and the main case 2, a neutral return spring is provided for maintaining the state in that the basic tooth 672*a* of the intermittent gear 672 of the worm wheel 670 turns toward the center of axis of the gear shaft 651 (hereinafter, referred to as a neutral state) although this is not shown.

When the sector gear 650 is rotated clockwise around the gear shaft 651 from the position shown in FIG. 10A (hereinafter, referred to as an unlocking position) to the position shown in FIG. 10B (hereinafter, referred to as a locking position), the teeth 654*a*, 654*b*, 654*c*, and 654*d* of the driven gear 654 of the sector gear 650 do not engage with any of the teeth 672*a*, 672*b*, and 672*c* of the intermittent gear 672, so that the worm wheel 670 cannot be rotated.

Likewise, when the sector gear 650 is rotated counterclockwise from the locking position shown in FIG. 10B to the unlocking position shown in FIG. 10A around the gear shaft 651, the worm wheel 670 does not rotate.

As shown in FIGS. 10A and 10B, the worm wheel 670 engages with a worm wheel 674 fixed to the output shaft of the drive motor 673. The drive motor 673 is positioned highest inside the housing 10 as shown in FIG. 4. Therefore, even when grease applied to the mechanisms arranged in the housing 10 liquefies, it does not reach the position of the drive motor 673. Namely, entering of the grease to the inside of the drive motor 673 is prevented.

When the worm wheel 670 is rotated counterclockwise around the worm shaft 671 from the state shown in FIG. 10A by driving of the drive motor 673, the basic tooth 672*a* engages with the outside tooth 654*a*, and then the first drive tooth 672*b* engages with the first passive tooth 654*c*, and furthermore, the second drive tooth 672*b* engages with the second passive tooth 654*d*. Thereby, as shown in FIG. 10B, the sector gear 650 rotates clockwise around the gear shaft 651 via the driven gear 654. Furthermore, according to the clockwise rotation of the sector gear 650, the link lever 40 rotates counterclockwise around the open working end 30*b* of the open lever 30 via the rotor 40*aa* and shifts to the locking position.

After the link lever 40 shifts from the unlocking position shown in FIG. 10A to the locking position shown in FIG. 10B by the rotation of the worm wheel 670, the link lever 40 cannot be rotated any more by the intermittent gear 672, and the worm wheel 670 returns to the neutral state due to the elastic returning force of a neutral returning spring (not shown) without rotating the link lever 40.

Likewise, when the worm wheel 670 is rotated clockwise around the worm shaft 671 from the state shown in FIG. 10B, the basic tooth 672*a* engages with the outside tooth 654*b*, and then the second drive tooth 672*c* engages with the second passive tooth 654*d*, and furthermore, the first drive tooth 672*b* engages with the first passive tooth 654*c*. Thereby, as shown in FIG. 10A, the sector gear 650 rotates counterclockwise around the gear shaft 651 via the driven gear 654. Furthermore, according to the counterclockwise rotation of the sector gear 650, the link lever 40 rotates clockwise around the open working end 30*b* of the open lever 30 via the rotor 40*aa* and shifts to the unlocking position.

After the link lever 40 shifts from the locking position shown in FIG. 10B to the unlocking position shown in FIG. 10A by the rotation of the worm wheel 670, the link lever 40 cannot be rotated any more by the intermittent gear 672, and the worm wheel 670 returns to the neutral state due to the elastic returning force of a neutral returning spring (not shown) without rotating the link lever 40.

In the lock mechanism 600, when it is in unlocked state, as shown in FIG. 6A and FIG. 7A, the ratchet driver 40*b* of the link lever 40 is arranged below the contact portion 25*a* of the ratchet lever 25.

In this unlocked state, the outside handle 1 is operated to open the door, and the open lever 30 is rotated counterclockwise around the open lever shaft 31 in FIG. 6A. Thereby, as shown in FIG. 6B, the ratchet driver 40*b* of the link lever 40 presses and raises the contact portion 25*a* of the ratchet lever 25 according to the upward movement of the open working end 30*b*. As a result, the engagement between the hook 21*b* of the latch 21 and the engaging portion 22*a* of the ratchet 22 is released, and it becomes possible to open the door D from the vehicle main body.

In the unlocked state, the inside handle 5 is operated to open the door, and the inner handle lever 50 is rotated counterclockwise around the inner lever shaft 51 in FIG. 7A. Thereby, as shown in FIG. 7B, the one-motion link 56 rises to push and raise the contact portion 25*a* of the ratchet lever 25. As a result, the engagement between the hook 21*b* of the latch 21 and the engaging portion 22*a* of the ratchet 22 is released, and it becomes possible to open the door D from the vehicle main body.

In the opened state of the door D, it is not possible that the door lock system is locked by operating only the inside lock button 6 to lock the door. This is because, when the door D is opened, that is, the latch 21 and the ratchet 22 is not in contact and engaged with each other, as shown in FIG. 4 and FIG. 6A, the working end 25*b* of the ratchet lever 25 is adjacent to the lock preventer 40*d* of the link lever 40 and prevents the link lever 40 from swinging counterclockwise.

However, in the opened state of the door D, by operating the inside lock button 6 to lock the door while the outside handle 1 or the inside handle 5 is operated to open the door, the door lock system can be locked. This is because, even when the door D is opened, by the door opening operation on the outside handle 1 or the inside handle 5, as shown in FIG. 6B and FIG. 7B, the link lever 40 rises and cancels the adjacent relationship between the working end 25*b* of the ratchet lever 25 and the lock preventer 40*d* of the link lever 40, and the working end 25*b* of the ratchet lever 25 does not block the counterclockwise swing of the link lever 40.

In the opened state of the door D, when the inside lock button 6 is operated to lock the door while the inside handle 5 is operated to open the door, the one-motion projection 634 presses the one-motion lever 53 according to the rotation of the connect lever 630, whereby the one-motion lever 53 rotates by using the one-motion lever joint hole 50*c* as a center of rotation against the pressing force of the one-motion spring 54. Thereafter, when the door opening operation on the inside handle 5 is interrupted, while the door lock system maintains a locked state, the one-motion lever 53 rotates by using the one-motion lever joint hole 50*c* as a center of rotation due to the pressing force of the one-motion spring 54 and returns to the original position.

On the other hand, when the inside lock button 6 in an unlocking state shown in FIG. 9A is operated to open the door while the door D is closed, the connect lever 630 swings counterclockwise around the convex portion 201 according to the rotation of the lock lever 640 as shown in FIG. 9B. Thereby, the sector gear 650 joined to the connect lever 630 via the joint convex portion 636 and the joint slot 656 swings clockwise around the gear shaft 651. When the sector gear 650 swings clockwise, the panic lever contact portion 655 of the sector gear 650 presses the sector gear contact portion 662 of the panic lever 660 and the panic lever 660 rotates clockwise around the gear shaft 651. Furthermore, according to the rotation of the panic lever 660, the link lever 40 swings counterclockwise, and the lock mechanism 600 is turned into a locked state.

In this locked state, even when the outside handle 1 is operated to open the door and the open lever 30 is rotated clockwise in FIG. 1, as shown in FIG. 9B, the ratchet driver 40*b* of the link lever 40 and the contact portion 25*a* of the ratchet lever 25 are apart from each other, so that the ratchet driver 40*b* and the contact portion 25*a* do not come into contact with each other, and the contact engagement between the hook 21*b* of the latch 21 and the engaging portion 22*a* of the ratchet 22 is not released. As a result, the door D is closed to the vehicle main body and the vehicle can be locked.

For switching from the unlocked state shown in FIG. 9A to a locked state shown in FIG. 9B, instead of the locking operation of the inside lock button 6, it is also allowed that the worm wheel 670 is rotated counterclockwise around the worm shaft 671 by the drive motor 673 to rotate the sector gear 650 clockwise around the gear shaft 651 as shown in FIG. 10B, or the key sub lever 620 is rotated counterclockwise around the convex portion 302 by the key operation on the key cylinder KC as shown in FIG. 8B.

From the locked state, when the inside lock button 6 is unlock-operated, as shown in FIG. 9A, the connect lever 630 swings clockwise according to the rotation of the lock lever 640. Thereby, the sector gear 650 joined to the connect lever 630 via the joint convex portion 636 and the joint slot 656 swings counterclockwise around the gear shaft 651. When the sector gear 650 swings counterclockwise, the panic lever 660 pressed by the panic spring 663 rotates counterclockwise around the gear shaft 651 by interlocking with the sector gear 650. Furthermore, according to the rotation of the panic lever 660, the link lever 40 swings clockwise, and the lock mechanism 600 is turned into an unlocked state.

In this unlocked state, when the inside handle 5 is operated to open the door, the locked state is switched to an unlocked state and the door opening operation of the inside handle 5 becomes effective, and the door opening operation of the inside handle 5 is transmitted to the ratchet 22. Then, it becomes possible to open the door D.

Figure 11A:
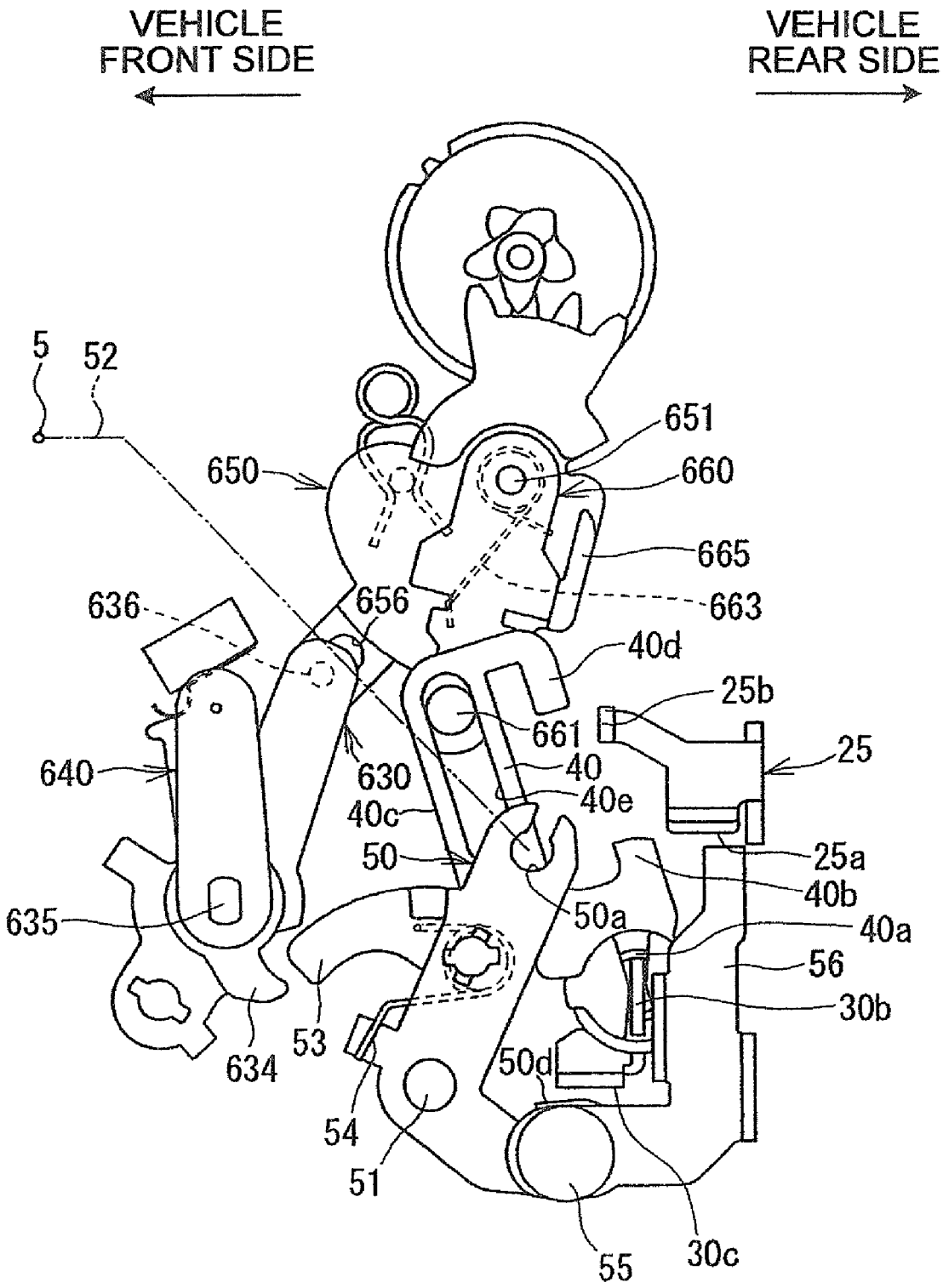
FIG. 11A is a schematic of the lock mechanism in a locked state before an inside handle is operated.
Figure 11B:
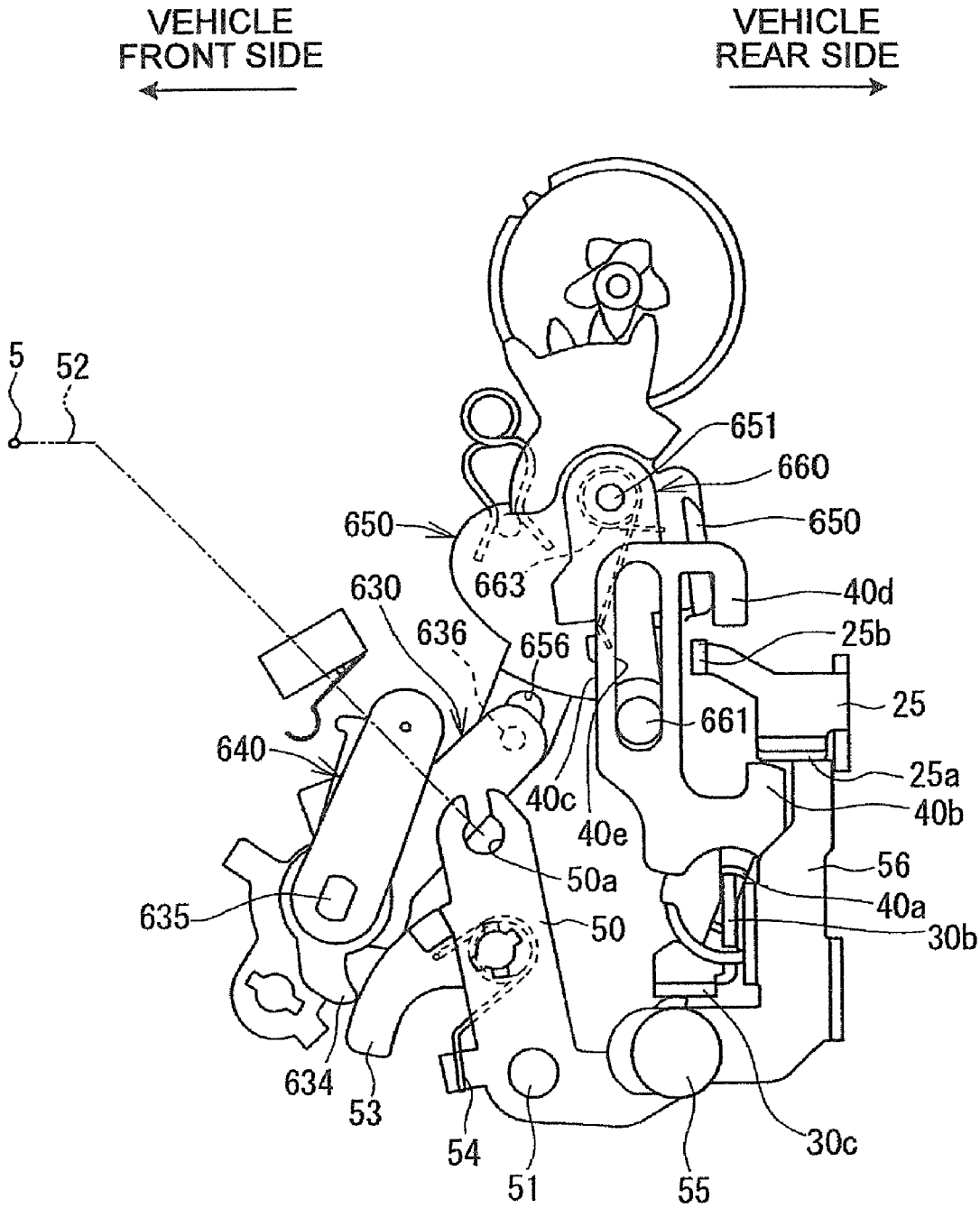
FIG. 11B is a schematic of the lock mechanism in an unlocked state by operating the inside handle to open the door.

A greater detailed description is given. In the locked state shown in FIG. 11A, when the inside handle 5 is operated to open the door, as shown in FIG. 11B, the inner handle lever 50 swings counterclockwise around the inner lever shaft 51. By the swing of the inner handle lever 50, the one-motion lever 53 that rotates integrally with the inner handle lever 50 presses the one-motion projection 634 of the connect lever 630 and swings the connect lever 630 clockwise around the convex portion 201. According to the swing of the connect lever 630, the sector gear 650 swings counterclockwise around the gear shaft 651, and the panic lever 660 pressed by the panic spring 663 rotates counterclockwise around the gear shaft 651 by interlocking with the sector gear 650. According to the rotation of the panic lever 660, the link lever 40 swings clockwise and switches the lock mechanism 600 to an unlocked state. Simultaneously, by the counterclockwise swing of the inner handle lever 50, the one-motion link 56 presses the contact portion 25*a* of the ratchet lever 25 and releases the contact engagement between the hook 21*b* of the latch 21 and the engaging portion 22*a* of the ratchet 22, and enables a door opening operation.

For switching from the locked state shown in FIG. 9B to the unlocked state shown in FIG. 9A, instead of the unlocking operation of the inside lock button 6 or the operation of the inside handle 5, it is also allowed that the worm wheel 670 is rotated clockwise around the worm shaft 671 by the drive motor 673 to rotate the sector gear 650 clockwise around the gear shaft 651 as shown in FIG. 10A, or the key sub lever 620 is rotated clockwise around the convex portion 302 by the key operation on the key cylinder KC as shown in FIG. 8A.

In the door lock system, while the one-motion lever 53 attached to the inner handle lever 50 shifts the link lever 40 from the locking position (see FIG. 11A) to the unlocking position (see FIG. 11B) by the door opening operation of the inside handle 5, the one-motion link 56 attached to the inner handle lever 50 transmits the door opening operation of the inside handle 5 to the ratchet lever 25. This realizes a so-called one-motion function. The door opening operation of the inside handle 5 is transmitted to the ratchet lever 25 through the one-motion link 56 regardless of the link lever 40. Thereby, the timing of shifting the link lever 40 from the locking position to the unlocking position and the timing of transmitting the door opening operation of the inside handle 5 to the ratchet lever 25 by the one-motion link 56 can be arbitrarily set. As a result, even with the door lock system with a one-motion function, the lock releasing timing and the door opening timing can be set by considering the operational feeling.

While, the link lever 40 can be shifted from the locking position to the unlocking position by the door opening operation of the inside handle 5 without fail, the door opening operation can be transmitted to the ratchet lever 25 by the one-motion link 56 without fail. Thereby, the locked state of the lock mechanism 600 is released, and there is no possibility that the door opening operation of the inside handle 5 is not transmitted to the ratchet lever 25.

Hereinafter, the key lever 610 in the door lock system is described in detail. FIGS. 12A to 12E depict a key lever and a bearing socket.

Figure 12A:
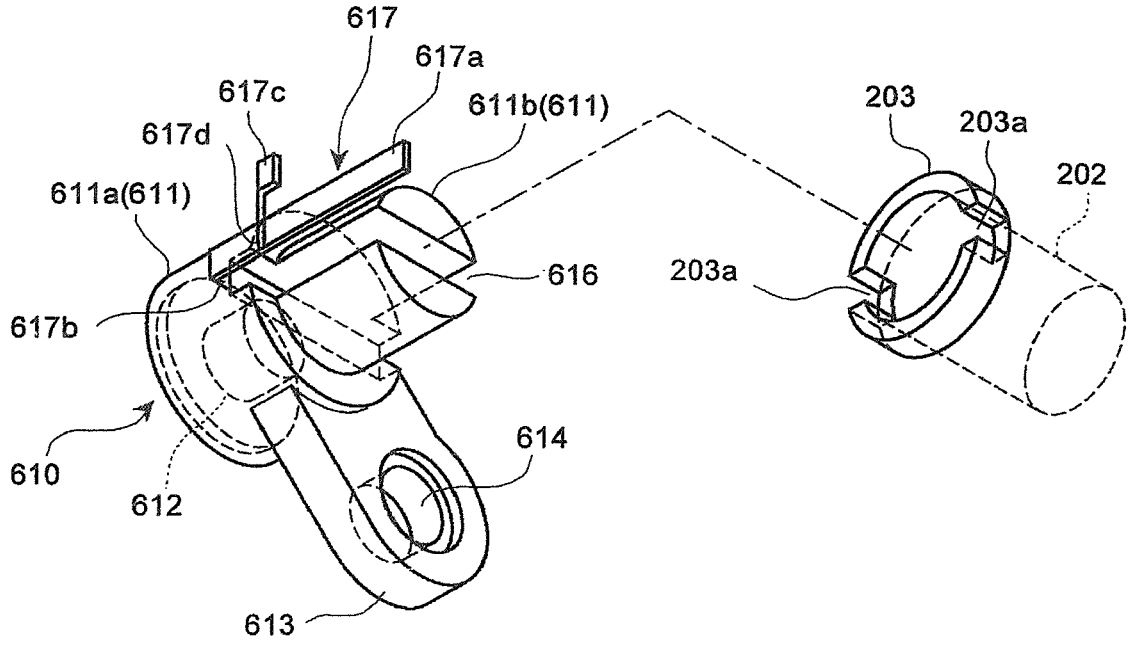
FIG. 12A is a perspective view of a key lever and a bearing socket.

The input shaft 611 of the key lever 610 is formed as shown in FIG. 12A so that the shaft 611*b* is integrated with a rotation base 611*a* and extended. The rotation base 611*a* is formed into a columnar shape. On one end of the rotation base 611*a*, a columnar shaft 611*b* formed to be thinner than the rotation base 611*a* is integrally provided. The rotating concave portion 612 is formed on the other end of the rotation base 611*a*.

The shaft 611*b* has a concave groove 616. The concave groove 616 is roughly shaped into a straight line that divides vertically the shaft 611*b* into two along the axial direction of the shaft 611*b*. This concave groove 616 also extends to a part of one end side of the rotation base 611*a*.

A seizing member 617 is provided on the outer circumference of the rotation base 611*a*. The seizing member 617 has a seizing piece 617*a* that can enter the concave groove 616 so as to penetrate the concave groove 616 from one side opening to the other side opening. This seizing piece 617*a* is cantilevered by being joined on its base end to the position of one side opening edge of the concave groove 616 continued from the bottom of the concave groove 616 via an elastic portion 617*b*. In the middle of the seizing piece 617*a*, a contact piece 617*c* extends. The contact piece 617*c* is cantilevered by being joined on its base end to the seizing piece 617*a* via an elastic portion 617*d* harder and more flexible than the elastic portion 617*b* and extends aslant outward of the seizing piece 617*a*. This contact piece 617*c* is arranged so that its free end extends toward the front end of the shaft 611*b* within the concave groove 616 when the seizing piece 617*a* enters the concave groove 616.

The lever portion 613 is provided on the outer circumference of the rotation base 611*a* so as to extend away from the center of the rotation base 611*a*.

Figure 2:
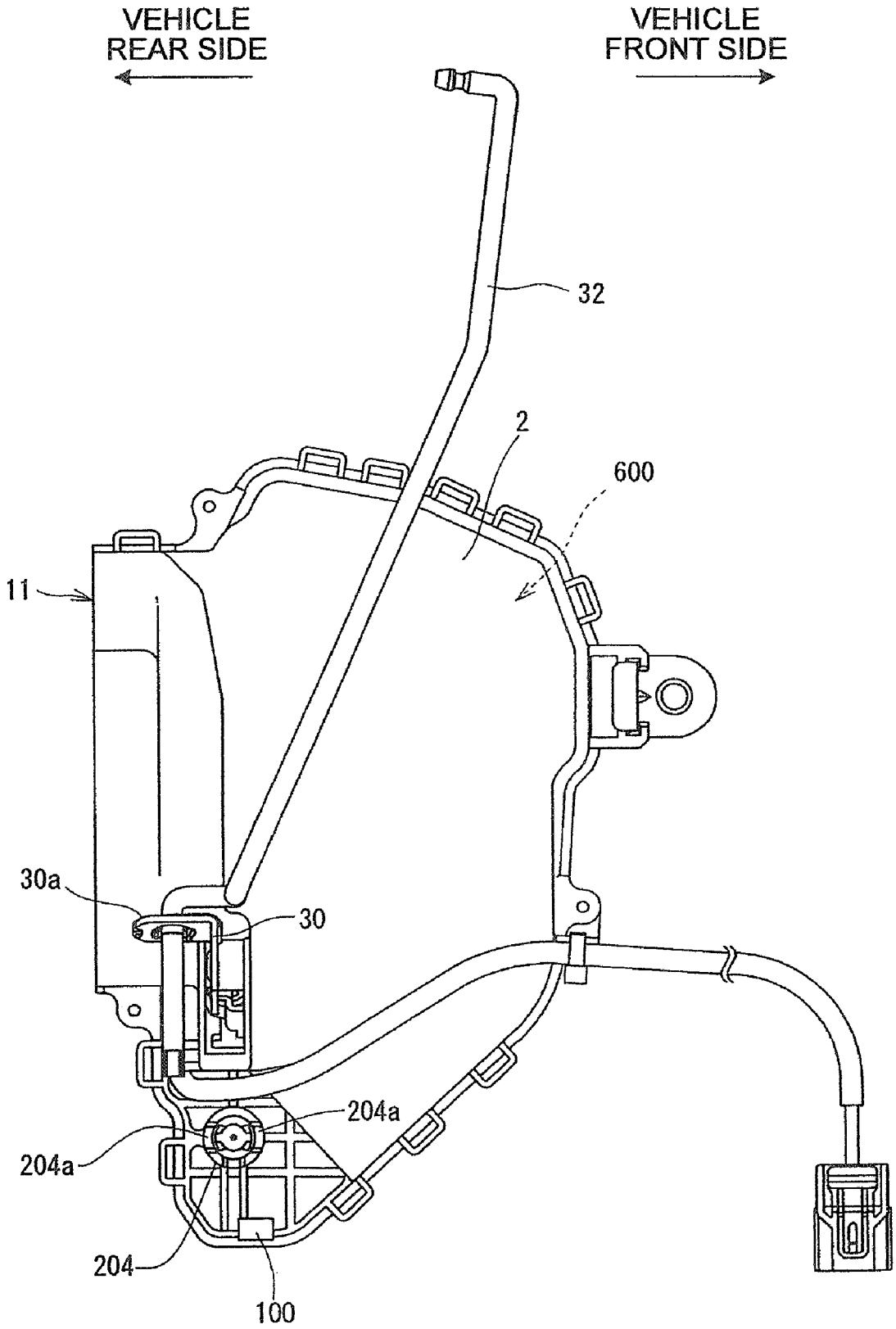
FIG. 2 is a view of the door lock system shown in FIG. 1 from the outdoor side.
Figure 3:
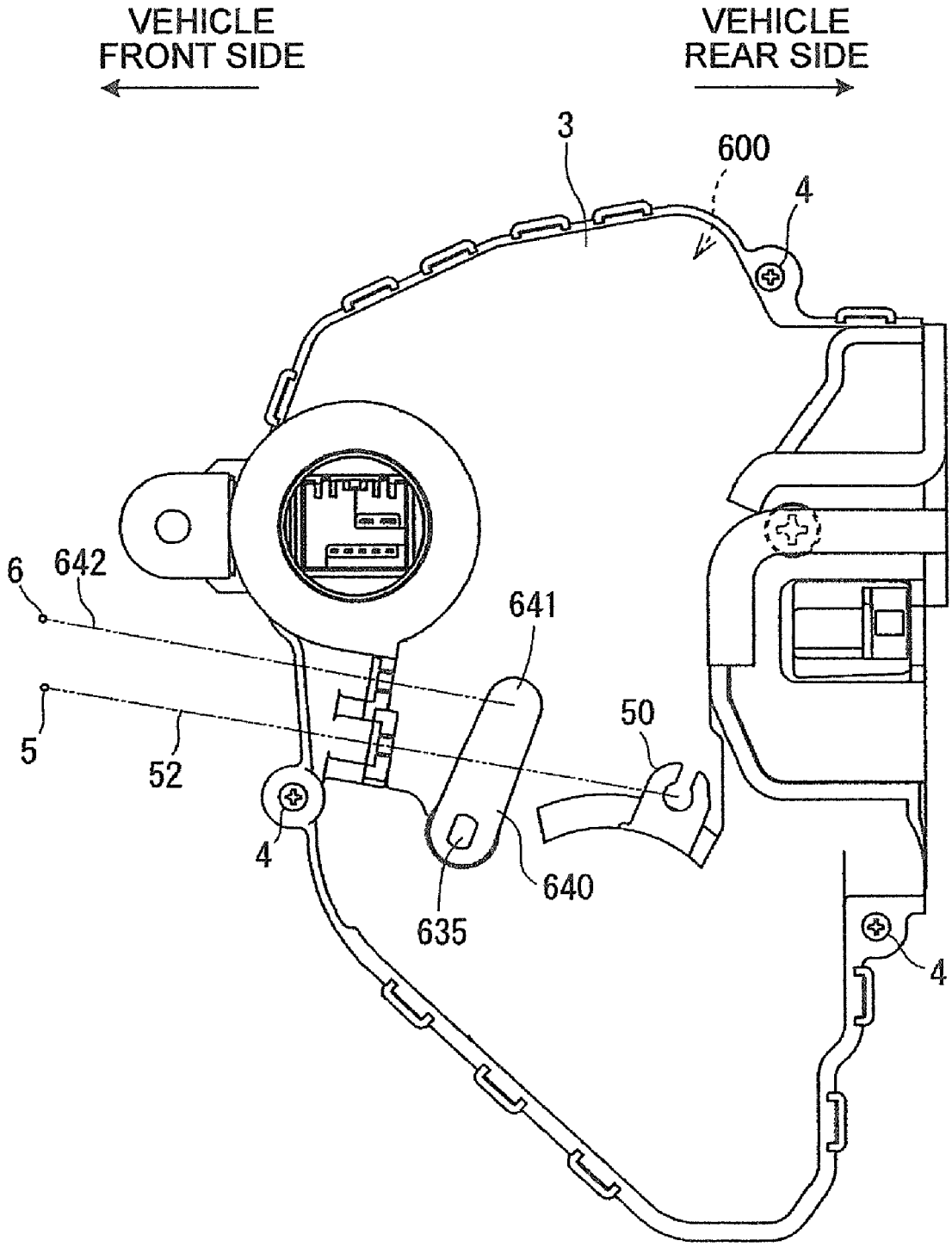
FIG. 3 is a view of the door lock system shown in FIG. 1 from the indoor side.

The key lever 610 is rotatably supported so that the input shaft 611 is rotatable inside the housing 10 between the main case 2 and the sub case 3 by fitting the rotating concave portion 612 to the convex portion 302 formed on the sub case 3 and fitting the shaft 611*b* into a bearing socket 202 formed in the main case 2. The convex portion 302 and the bearing socket 202 are provided at the lower side of the housing 10, and the input shaft 611 is arranged below the housing 10. The input shaft 611 is arranged at the lower side of the electrical parts including the switch 628, the switch 637, and the drive motor 673 provided inside the housing 10 as shown in FIG. 4. As shown in FIG. 2 and FIG. 4, at the bottom of the housing 10 provided with the input shaft 611, a drain hole 100 is opened. The drain hole 100 communicates with the inside and the outside of the housing 10, and is provided on the main case 2 in the first embodiment. The drain hole 100 may be provided on the sub case 3 side or may be formed across the main case 2 and the sub case 3 as long as it is opened at the bottom of the housing 10.

The bearing socket 202 is formed so as to penetrate to the outside of the housing 10. As shown in FIG. 12A, the bearing socket 202 has an inner diameter that makes the shaft 611*b* of the input shaft 611 to be inserted through and rotatably supported by the bearing socket. This bearing socket 202 has a cylindrical unit 203 on the opening edge turned toward the inside of the housing 10. The cylindrical unit 203 has an inner diameter that makes the shaft 611*b* of the input shaft 611 to be inserted through and supported by the cylindrical unit like the bearing socket 202. In the cylindrical unit 203, notched grooves 203*a* are formed. The notched grooves 203*a* are opposite each other on the edges turned inward of the housing 10, and communicate with the concave groove 616 when the shaft 611*b* is inserted into the bearing socket 202.

Communication between the concave groove 616 and the notched groove 203*a* is made when the input shaft 611 is at a predetermined rotating position. Herein, the predetermined rotating position of the input shaft 611 is described. The input shaft 611 rotates counterclockwise in FIGS. 8A and 8B to lock the lock mechanism 600 when the key cylinder KC is operated to lock. On the other hand, the input shaft 611 rotates clockwise in FIGS. 8A and 8B to unlock the lock mechanism 600 when the key cylinder KC is operated to unlock. The key insertion hole of the key cylinder KC exposed to the outdoor side of the vehicle KC is positioned as predetermined and the direction of inserting the key into the key insertion hole is always fixed so as to make the key operation easy. The predetermined rotating position of the input shaft 611 corresponds to the predetermined position of the key insertion hole of the key cylinder KC, and is almost at the center of rotation of the rotating operation, which is a neutral position to make the rotating operation amounts of the key cylinder and the input shaft equal when the rotation of the key cylinder KC reaches the input shaft 611 by a key operation.

Figure 12B:
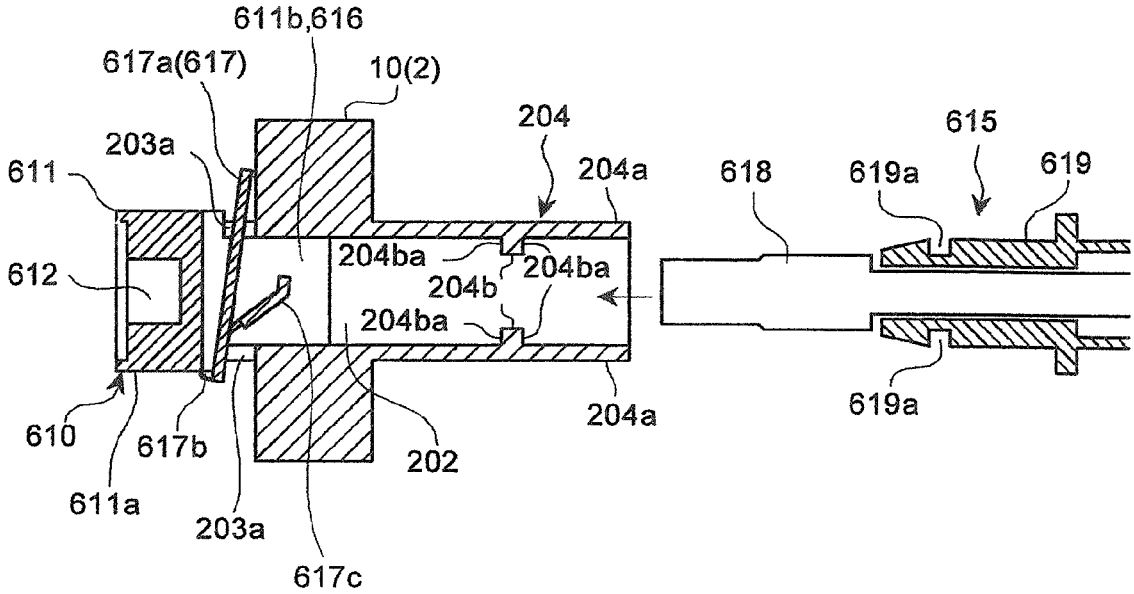
FIG. 12B is a cross-sectional view of an operation to engage an input shaft and an output shaft.

The bearing socket 202 has a seizing cylinder 204 on the opening edge turned outward of the housing 10 as shown in FIG. 1, FIG. 2, and FIG. 12B. The seizing cylinder 204 extends in a cylindrical shape toward the outside of the housing 10. In this seizing cylinder 204, a pair of slit grooves are formed from the extending front end to the base end to form elastic pieces 204*a* that warp in the out-of-diameter direction of the seizing cylinder 204 between the slit grooves. The elastic pieces 204*a* are provided at two positions opposite each other in the out-of-diameter direction of the seizing cylinder 204. On the inner walls of the elastic pieces 204*a* on the seizing cylinder 204, seizing projections 204*b* are provided. The seizing projections 204*b* have seizing surfaces 204*ba* formed flat toward the front end and the base end of the seizing cylinder 204.

In the bearing socket 202, the key cylinder link unit 615 extending from the key cylinder KC provided on the door D is inserted from the outside of the housing 10 as shown in FIG. 1.

As shown in FIG. 12B, on the front end of the key cylinder link unit 615 to be inserted into the bearing socket 202, an output shaft 618 is provided that transmits a rotating operation when the key cylinder KC is operated to lock or the key cylinder KC is operated to unlock to the input shaft 611 and the output shaft 618 is exposed to the surface.

The output shaft 618 is joined to the key cylinder KC, formed into a long rod shape, and has a long plate-shaped (for example, having a roughly straight sectional shape) that engages with the concave groove 616 of the shaft 611*b*. This output shaft 618 is installed in the outer cylinder 619. Namely, the rotation of the key cylinder KC in response to a key operation is transmitted to the input shaft 611 by the rotation of the output shaft 618 inside the outer cylinder 619. The front end of the outer cylinder 619 is formed with a slant portion gradually increasing in thickness toward the base end side, and on the outer circumference of the outer cylinder 619 on the base end side of the slant portion, seizing grooves 619*a* that fit the seizing projections 204*b* provided on the respective elastic pieces 204*a* of the seizing cylinder 204 in the bearing socket 202 are provided. The seizing grooves 619*a* have inner diameters that make the seizing grooves surface-contact with the seizing surfaces 204*ba* of the seizing projections 204*b*. The outer cylinder 619 is inserted through the seizing cylinder 204 to engage the seizing grooves 619*a* and the seizing projections 204*b* with each other, whereby the output shaft 618 is prevented from coming out of the bearing socket 202, and the engagement of the front end of the output shaft 618 extending from the front end of the outer cylinder 619 with the concave groove 616 of the shaft 611*b* of the input shaft 611 is maintained.

Figure 12C:
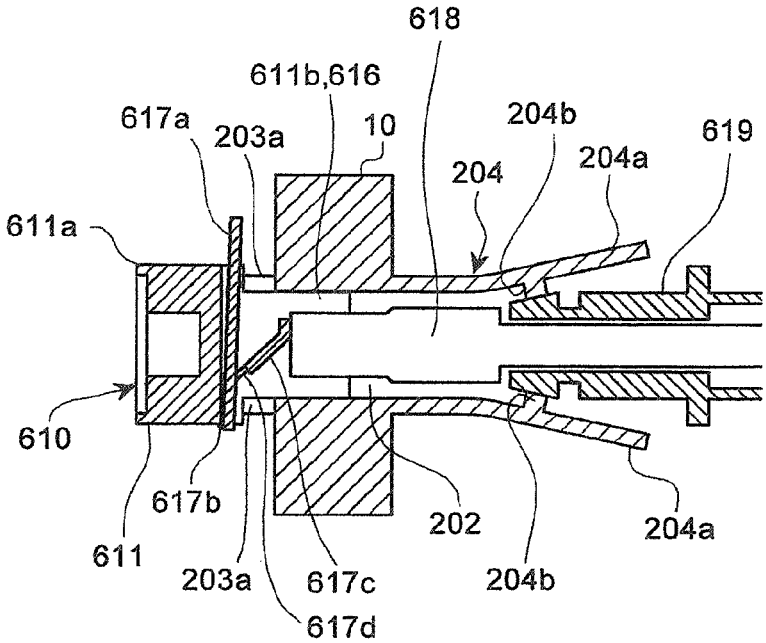
FIG. 12C is a cross-sectional view of an operation to engage the input shaft and the output shaft.
Figure 12D:
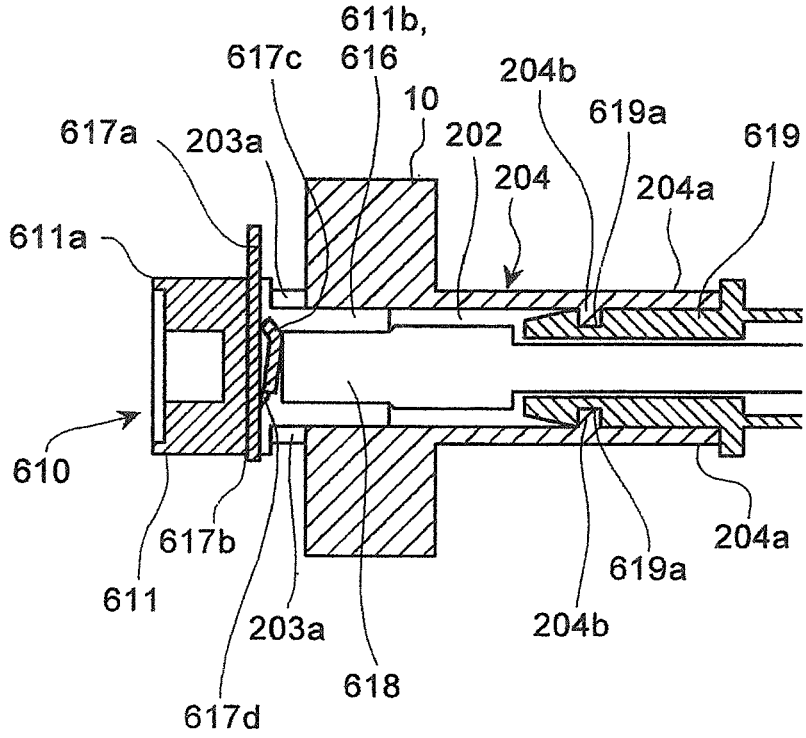
FIG. 12D is a cross-sectional view of an operation to engage the input shaft and the output shaft.

The operation to engage the input shaft 611 and the output shaft 618 is described with reference to FIG. 12B through FIG. 12E. FIG. 12B through FIG. 12D are sectional views cut along the concave groove 616 and the notched groove 203*a*, and FIG. 12E is a sectional view cut orthogonally to FIG. 12B through FIG. 12D.

First, as shown in FIG. 12B, the input shaft 611 is inserted into the bearing socket 202. To insert the input shaft 611 into the bearing socket 202, the elastic portion 617*b* is bent so that the seizing piece 617*a* of the seizing member 617 enters inside the concave groove 616. Then, in this state, the shaft 611*b* is inserted into the bearing socket 202. The concave groove 616 is made to communicate with the notched groove 203*a* of the cylindrical unit 203 in the bearing socket 202 and the rotation base 611*a* is made to contact the edge of the cylindrical unit 203. Thereby, the seizing piece 617*a* is positioned in both the concave groove 616 and the notched groove 203*a*, and it is inserted into the notched groove 203*a* while being inserted inside the concave groove 616. As a result, the seizing piece 617*a* maintains the communication between the concave groove 616 and the notched groove 203*a*, so that the input shaft 611 is seized at the predetermined rotating position and the rotation thereof is restricted. In this state, the contact piece 617*c* elastically projects in the front end opening direction of the concave groove 616 from the seizing piece 617*a* via the elastic portion 617*d*.

Next, as shown in FIG. 12C, the output shaft 618 is inserted into the bearing socket 202 from the outside of the housing 10 through the seizing cylinder 204. The front end of the output shaft 618 engages with the concave groove 616 of the input shaft 611 and pushes the contact piece 617*c* of the seizing member 617 into the bottom of the concave groove 616. At this point, in the seizing member 617, since the elastic portion 617*d* on the base end of the contact piece 617*c* is harder than the elastic portion 617*b* on the base end of the seizing piece 617*a*, only the elastic portion 617*b* warps and the seizing piece 617*a* is pushed into the bottom of the concave groove 616. As a result, the seizing piece 617*a* is pushed out of the notched groove 203*a* and releases the seizing of the input shaft 611 and allows the input shaft to rotate. The outer cylinder 619 internally having the output shaft 618 is inserted into the seizing cylinder 204, and at this point, the seizing projections 204*b* come into contact with the slant portion of the front end of the outer cylinder 619, whereby the elastic pieces 204*a* having the seizing projections 204*b* warp in the out-of-diameter direction of the seizing cylinder 204. In the state of FIG. 12C, the output shaft 618 has already engaged with the concave groove 616 of the input shaft 611, so that the input shaft 611 does not rotate as long as rotation is not transmitted from the output shaft 618.

Figure 12E:
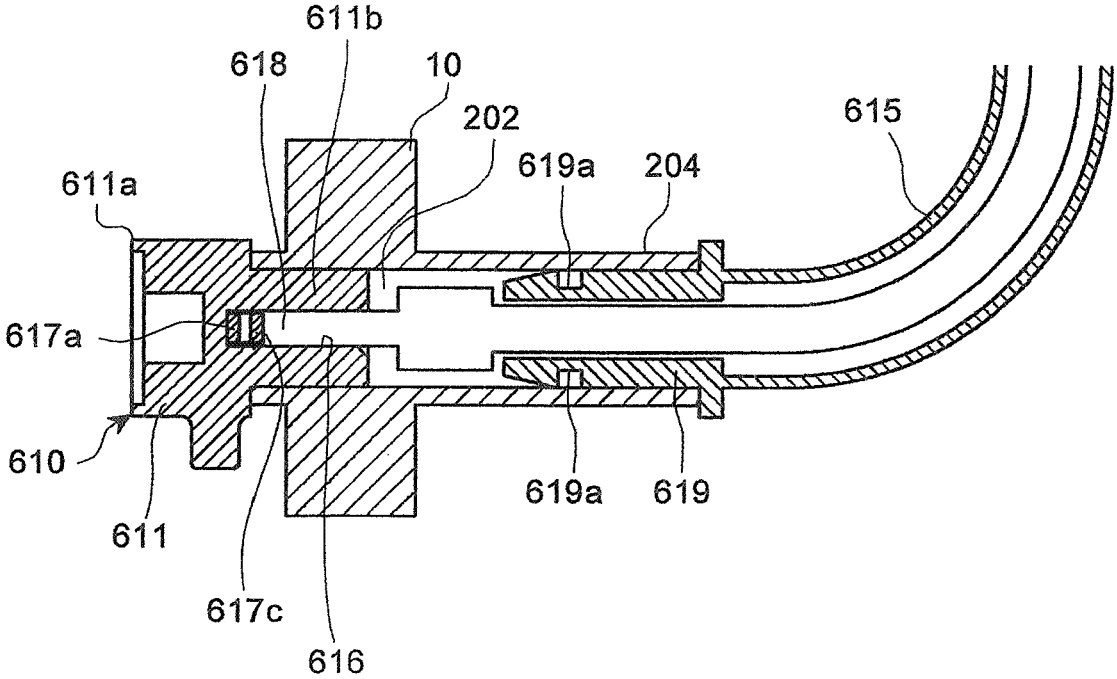
FIG. 12E is a cross-sectional view of an operation to engage the input shaft and the output shaft.

Last, as shown in FIG. 12D and FIG. 12E, the output shaft 618 is further inserted to the bottom of the concave groove 616. At this point, the elastic pieces 204*a* of the seizing cylinder 204 return to their original positions by their own elasticity, and the seizing groves 619*a* formed in the outer cylinder 619 and the seizing projections 204*b* provided on the seizing cylinder 204 engage with each other. Thereby, the output shaft 618 is prevented from coming out of the bearing socket 202, and the engagement of the output shaft 618 with the concave groove 616 of the input shaft 611 is maintained. At this point, the contact piece 617*c* of the seizing member 617 is further pushed into the bottom side of the concave groove 616 by the front end of the output shaft 618. Since the seizing piece 617*a* has reached the bottom of the concave groove 616, the elastic portion 617*d* of the contact piece 617*c* warps and further pushes the seizing piece 617*a* into the concave groove 616.

The key lever 610 rotates only when the key cylinder KC is key-operated, and switches the lock mechanism 600 to a locked state or an unlocked state. In detail, the rotation of the key lever 610 is transmitted to the key sub lever 620 through the key link 627 to rotate the connect lever 630 around the convex portion 302. Furthermore, the rotation of the key lever 610 is transmitted to the key sub lever 620 through the key link 627 to rotate the lock lever 640 around the rotation shaft 635 and switches the inside lock button 6 to a locked state or an unlocked state via the lock button link unit 642. However, the locking or unlocking operation of the inside lock button 6 and the rotation of the sector gear 650 are not transmitted to the key lever 610. To realize this method of transmission of operations, in this door lock system, an idling region is provided between the key sub lever 620 and the connect lever 630.

The key lever 610 seizes the input shaft 611 at a predetermined rotating position (neutral position) by the positioning unit including the concave groove 616, the notched groove 203*a*, and the seizing member 617 until the output shaft 618 and the input shaft 611 engage with each other, and allows the input shaft 611 to rotate when the output shaft 618 and the input shaft 611 engage with each other. Namely, it becomes possible to prevent that the input shaft 611 rotates within the idling region before the output shaft 618 engages with the input shaft 611. As a result, when the rotation of the key cylinder KC in response to an external key operation is transmitted to the lock mechanism 600 as a rotating drive force, the rotation range of the input shaft 611 into the unlocking state or the locking state is prevented from shifting.

Therefore, in the door lock system, an input portion that inputs a drive force from the outside of the housing 10 to switch the lock mechanism 600 between an unlocked state and a locked state is arranged on the lower side of the housing 10. The input portion is the input shaft 611 of the key lever 610, which inputs a rotating drive force from the key cylinder KC in response to a key operation. Namely, by arranging the input shaft 611 at the lower side of the housing 10, even when rain water adhering to the key cylinder KC or a window glass provided within the door D reaches the input shaft 611 through the key cylinder link unit 615, the rain water does not reach the mechanisms inside the housing 10. As a result, the mechanisms housed inside the housing 10 are prevented from malfunctioning. Particularly, since the input shaft 611 is arranged below the electrical parts, the electrical parts are prevented from malfunctioning. Furthermore, a drain hole 100 is formed on the lower portion of the housing 10, so that rain water entering inside the housing 10 is drained out of the housing 10.

An input portion that inputs a drive force from the outside of the housing 10 to switch the lock mechanism 600 between an unlocked state and a locked state also includes the rotation shaft 635 which fixes the lock lever 640 that inputs a drive force in response to an operation on the inside lock button 6. In the first embodiment, this rotation shaft 635 is arranged at a comparatively lower position of the housing 10 below the electrical parts provided inside the housing 10. Namely, by arranging the rotation shaft 635 at a lower position of the housing 10, even when rain water adhering to a window glass provided within the door D reaches the rotation shaft 635 through the lock button link unit 642, the rain water is prevented from reaching the mechanisms inside the housing 10. As a result, the mechanisms housed inside the housing 10 are prevented from malfunctioning. Particularly, since the rotation shaft 635 is arranged below the electrical parts, the electrical parts are prevented from malfunctioning. Furthermore, a drain hole 100 is provided at a lower portion of the housing 10, rain water entering inside the housing 10 is drained out of the housing 10.

A door lock system according to a second embodiment of the present invention explained with reference to FIGS. 13 to 16. This door lock system is provided in a side door (hereinafter, referred to as a door) of the front hinge nearest to the driver's seat (with a right-hand steering wheel). This door lock system is attached inside the door by integrating a lock mechanism housing 710 that houses a lock mechanism and an actuator mechanism and a latch mechanism housing 720 that houses a latch mechanism 730.

Figure 13:
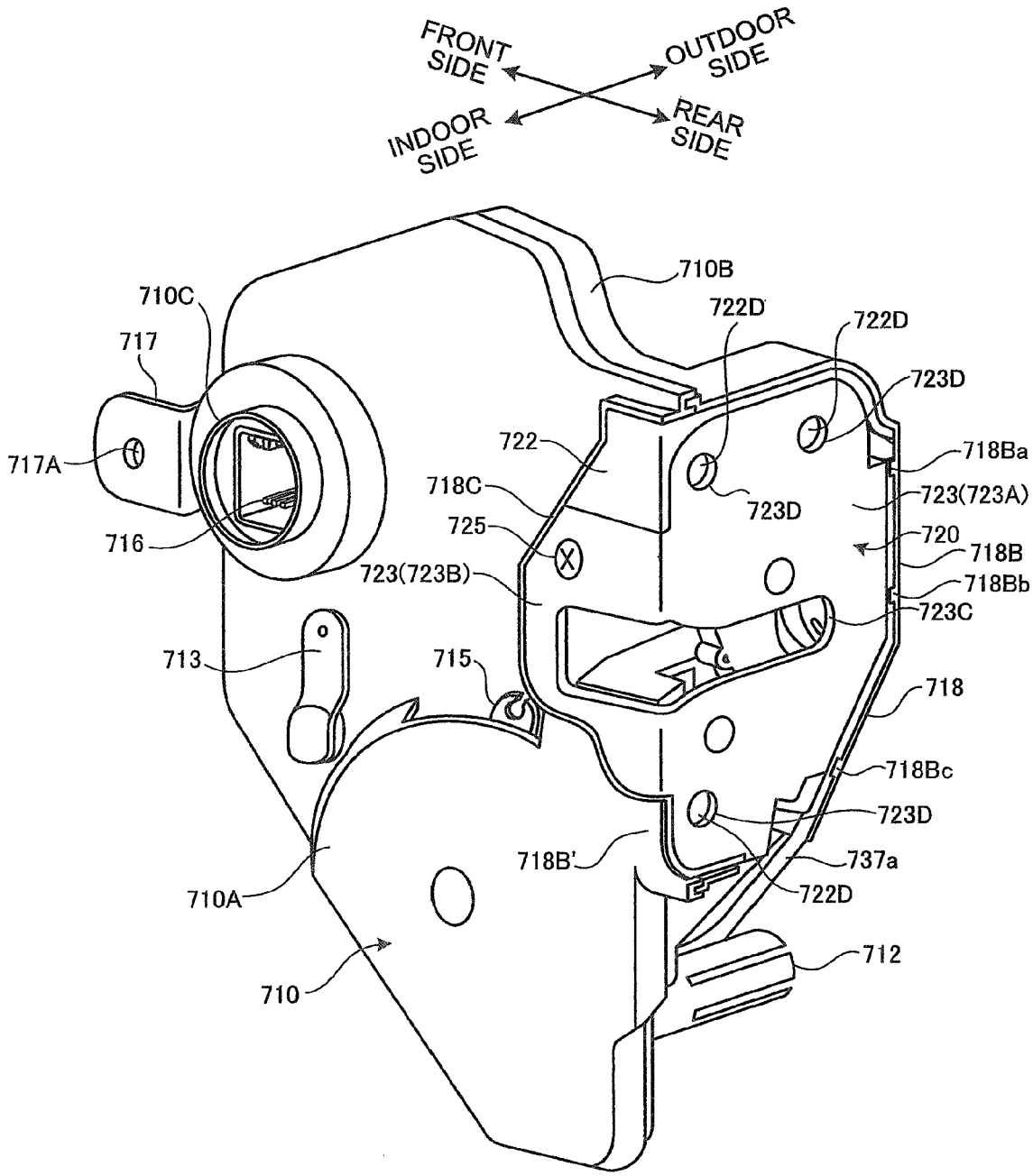
FIG. 13 is a perspective view from the indoor side of the door of a door lock system according to a second embodiment of the present invention.
Figure 14:
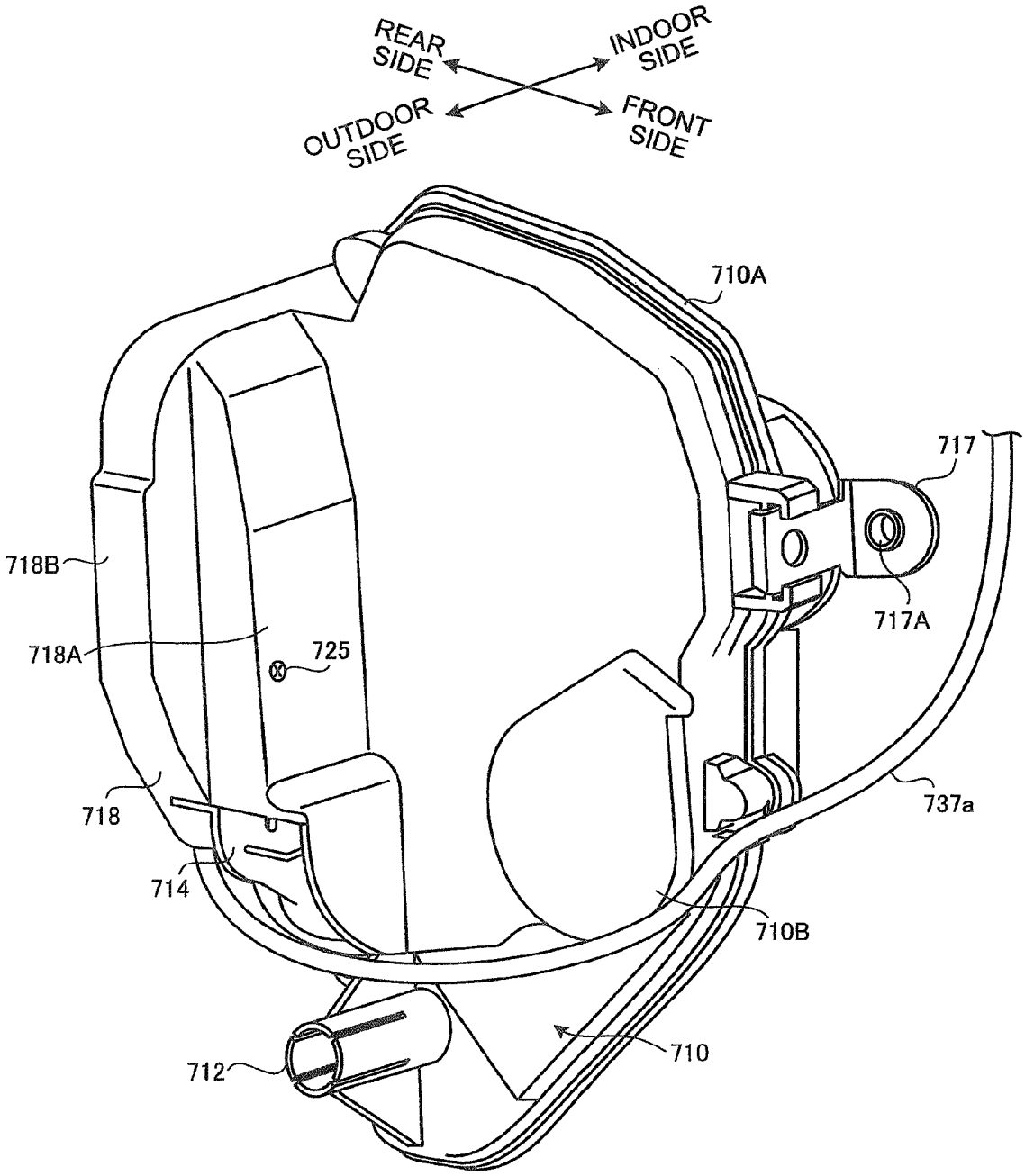
FIG. 14 is a perspective view from the outdoor side of the door of the door lock system shown in FIG. 13.

The lock mechanism housing 710 includes a main case 710A and a sub case 710B as shown in FIG. 13 and FIG. 14. The main case 710A and sub case 710B are formed from a synthetic resin material, and are joined and then fastened to each other by a fastening unit such as a screw (not shown). The main case 710A is positioned on the indoor side in the door lock system, and the sub case 710B is positioned on the outdoor side of the door. The lock mechanism and the actuator mechanism are housed in the space between the main case 710A and the sub case 710B extending along the door front and rear direction. A packing member (not shown) is provided at the joint portion between the main case 710A and the sub case 710B to obtain watertightness and dust resistance.

The lock mechanism can be switched between an unlocked state and a locked state by a key operation on the key cylinder provided on the outdoor side of the door or by an operation on the inside lock button provided on the indoor side of the door although these are not shown. This lock mechanism enables a door opening operation of the outside handle in an unlocked state and transmits the operation to the latch mechanism 730, and on the other hand, in a locked state, the lock mechanism disables the door opening operation of the outside handle and does not transmit the operation to the latch mechanism 730.

A seizing cylinder 712 is provided on the outdoor side of the door outside the lock mechanism housing 710 and the seizing cylinder 712 is extended in which the output shaft (not shown) that transmits the key operation on the key cylinder to the lock mechanism is inserted. On the indoor side of the door outside the lock mechanism housing 710, an inside lock lever 713 is provided which swings in response to an operation on the inside lock button. On the outdoor side of the door outside the lock mechanism housing 710, an outside handle lever 714 is provided and extended which swings in response to a door opening operation on the outside handle. On the indoor side of the door outside the lock mechanism housing 710, an inside handle lever 715 is provided and extended which swings in response to a door opening operation on the inside handle (not shown).

The actuator mechanism switches the lock mechanism between an unlocked state and a locked state in response to electrical signals generated by operations on a remote controller, a switch, or the like although this is not shown. This actuator mechanism includes a drive motor, a motor link unit such as a gear that transmits the driving of the drive motor to the lock mechanism, and a detection unit that detects an unlocked state and a locked state. The actuator mechanism further includes a connector 716 for supplying electrical power to the drive motor from the outside of the lock mechanism housing 710, inputting electrical signals, or outputting electrical signals to the outside of the lock mechanism housing 710 from the detection unit. This connector 716 is exposed to the outside of the lock mechanism housing 710 via an opening extended portion 710C extending to the indoor side of the door of the lock mechanism housing 710. To the connector 716, an external connector (not shown) for supplying electrical power and inputting and outputting electrical signals is connected.

On the portion of the door front side of the sub case 710B near the opening extended portion 710C, a fixing member 717 is provided. The fixing member 717 is formed of a steel plate extending to the door front side, in which a female screw hole 717A is formed.

On the door rear side of the lock mechanism housing 710, a latch mechanism attaching portion 718 extending to the indoor side of the door is provided and shaped into almost an L when viewed from above.

Figure 15:
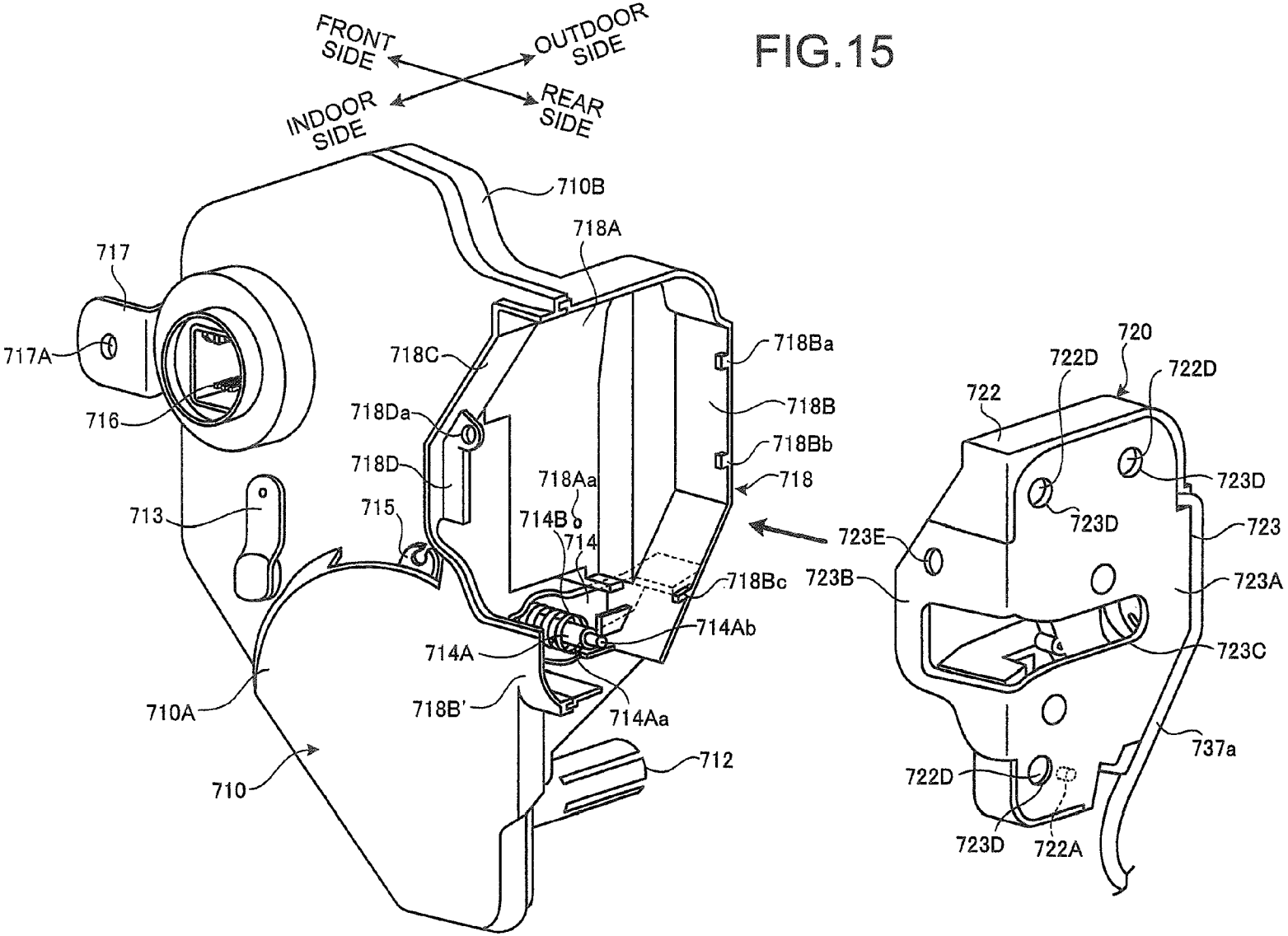
FIG. 15 is an exploded perspective view of the door lock system shown in FIG. 13 disassembled into a lock mechanism housing and a latch mechanism housing.

The latch mechanism attaching portion 718 is provided across the main case 710A and the sub case 710B on the door rear side of the door lock system, and as shown in FIG. 14 and FIG. 15, the latch mechanism attaching portion 718 has a casing 718A extending to the outdoor side of the door from the end of the door rear side of the sub case 710B. On the upper and lower sides and the outdoor side of this casing 718A, a circumferential wall 718B extending to the door rear side is formed so as to continue to the joint edge on the door rear side between the main case 710A and the sub case 710B. Therefore, the circumferential wall 718B opens the casing 718A to the door rear side.

On three points of the circumferential wall 718B, claws 718Ba, 718Bb, and 718Bc rising toward the inside of the casing 718A are provided. These claws 718Ba, 718Bb, and 718Bc prevent a signal cable 737*a* described later from bulging out when the latch mechanism housing 720 is attached to the latch mechanism attaching portion 718.

The latch mechanism attaching portion 718 has, on the main case 710A side, a circumferential wall 718B' that continues from the joint edge on the door rear side between the main case 710A and the sub case 710B and encloses a part of the indoor side, and has an opening 718C opened to the indoor side. Furthermore, the latch mechanism attaching portion 718 has attaching holes 718Aa and 718Da for the casing 718A and the seizing piece 718D extending from the opening edge of the opening 718C.

On the deep side (door front side) of the latch mechanism attaching portion 718, as shown in FIG. 15, the outside handle lever 714 is provided. The outside handle lever 714 is supported so as to swing around the shaft 714A, and the end extending to the outside of the lock mechanism housing 710 is pressed in the non-operating direction (upward in FIG. 15) by a spring 714B wound around the shaft 714A. The base end of the shaft 714A is fixed to the deep side of the latch mechanism attaching portion 718, and a front end 714Aa that extends to the door rear side as a free end. On the front end 714Aa of the shaft 714A, a seizing portion 714Ab formed to be thinner than the outer diameter of the shaft 714A is provided and extended to the door rear side.

The latch mechanism housing 720 is attached to the latch mechanism attaching portion 718, and the right side surface is formed slightly smaller than the circumferential wall 718B of the casing 718A so as to separate from the circumferential wall 718B for wiring the signal cable 737*a* described later between the casing 718A of the latch mechanism attaching portion 718 and the latch mechanism housing 720.

Figure 16:
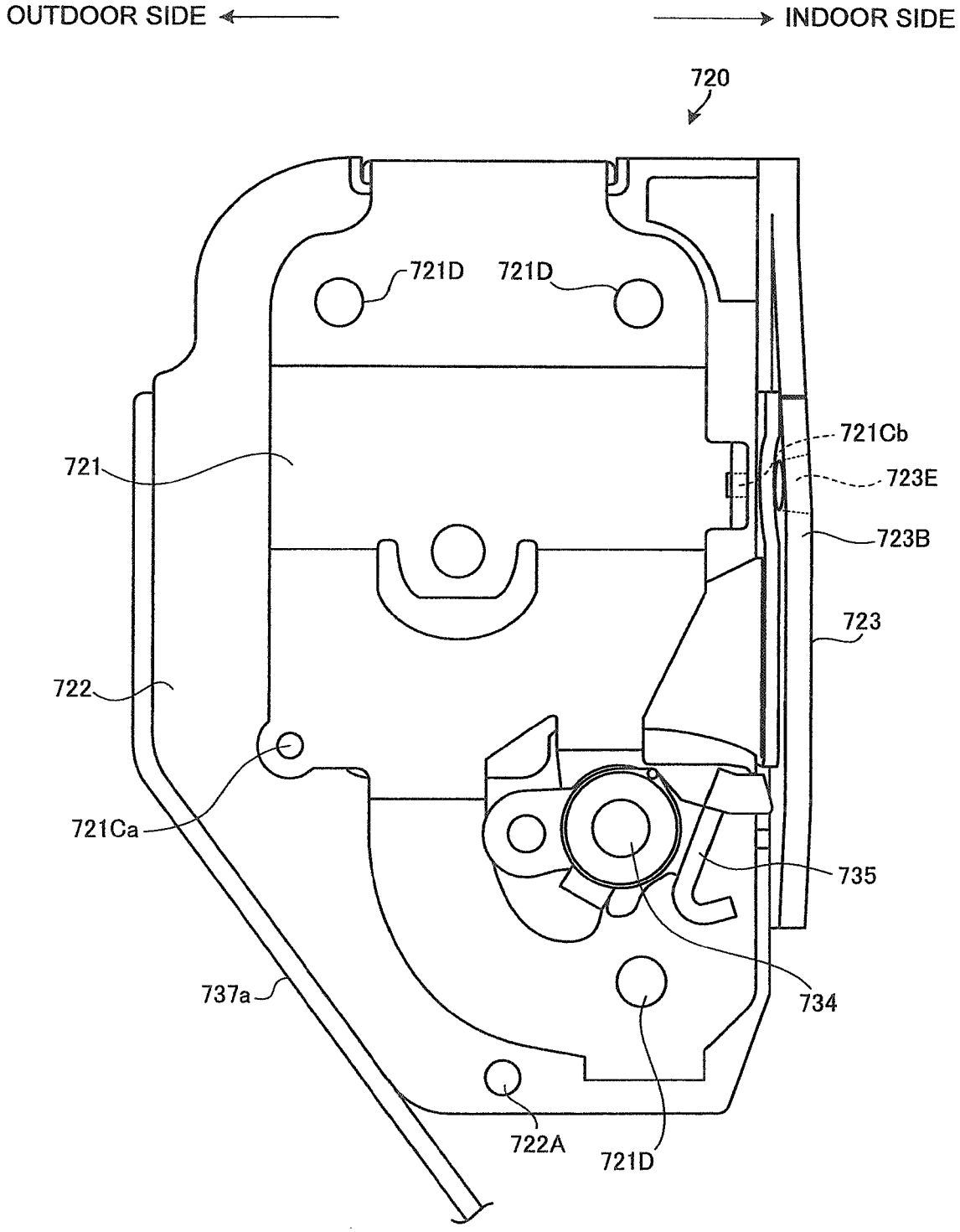
FIG. 16 is a view of a latch mechanism housing from the front side of the door.

The latch mechanism housing 720 includes, as shown in FIG. 15 and FIG. 16, a base plate 721, a latch case 722, and a cover plate 723. The base plate 721 is formed of a steel plate and forms the door front side of the latch mechanism housing 720 as shown in FIG. 16. In the base plate 721, attaching screw holes 721Ca and 721Cb to which attaching screws 725 are screwed to attach the latch mechanism housing 720 to the latch mechanism attaching portion 718 are opened toward the front side and the indoor side of the door. In the base plate 721, fixing screw holes 721D to which fixing screws (not shown) to attach the door lock system to the door are screwed are also formed at three points.

The latch case 722 is formed from a synthetic resin material, and provided on the door rear side of the base plate 721. On the door front side of the latch case 722, a concave portion 722A is provided in which the seizing portion 714Ab extending on the front end 714Aa of the shaft 714A of the outside handle lever 714 is inserted. In the latch case 722, through holes 722D through which fixing screws for attaching the door lock system to the door are inserted are provided at three points.

The cover plate 723 is formed of a steel plate and forms the door rear side of the latch mechanism housing 720 as shown in FIG. 15. The cover plate 723 is roughly formed into an L shape when viewed from above by a rear side plate 723A that extends to the outdoor side of the door and fits the door rear side of the base plate 721 and an indoor side plate 723B that extends to the door front side and fits the indoor side of the base plate 721. In the cover plate 723, a notched groove 723C is formed which extends almost horizontally across the indoor side plate 723B and the rear side plate 723A from the indoor side to the outdoor side at the almost middle position in a vertical direction of the cover plate.

In the rear side plate 723A of the cover plate 723, fixing insertion holes 723D in which fixing screws for attaching the door lock system to the door are formed at three points. The fixing insertion holes 723D communicate with the through holes 722D of the latch case 722 and the fixing screw holes 721D of the base plate 721. In the indoor side plate 723B of the cover plate 723, an attaching insertion hole 723E is formed in which an attaching screw 725 for attaching the latch mechanism housing 720 to the latch mechanism attaching portion 718 is formed. This attaching insertion hole 723E communicates with the attaching screw hole 721Cb of the base plate 721 by leaving a predetermined space as shown in FIG. 16.

In the latch mechanism housing 720, with respect to the upper and lower sides and the door rear side, the outer form of the upper and lower sides and the door rear side of the latch case 722 forms the outer form of the latch mechanism housing 720, and with respect to the indoor side, a part of the latch case 722 and the indoor side plate 723B of the cover plate 723 form the outer form of the latch mechanism housing 720. Furthermore, with respect to the door front side, the outer form of the door front side of the base plate 721 forms the outer form of the latch mechanism housing 720.

The latch mechanism 730 is housed in the latch case 722. The latch mechanism 730 is for engaging and retaining the striker S provided on the vehicle main body side of a four-wheeled vehicle like a conventional one, and includes a latch 731 and a ratchet 732 as shown in FIGS. 5A to 5C.

The latch 731 is rotatably arranged higher than the notched groove 723C of the cover plate 723 via a latch shaft 733 extending almost horizontally along the front and rear direction of the vehicle main body from the base plate 721, and includes an engaging groove 731*a*, a hook 731*b*, and a seizing portion 731*c*.

The engaging groove 731*a* is formed toward the latch shaft 733 from the outer circumferential surface of the latch 731 so as to have a width that allows it to house the striker S.

The hook 731*b* is positioned at the more indoor side than the engaging groove 731*a* when the engaging groove 731*a* is opened downward. This hook 731*b* stops at a position (opening position) at which it opens the notched groove 723C of the cover plate 723 when the latch 731 is rotated clockwise as shown in FIG. 5A, and stops at a position (full-latching position) at which it crosses the notched groove 723C of the cover plate 723 when the latch 731 is rotated counterclockwise.

The seizing portion 731*c* is positioned at the more outdoor side than the engaging groove 731*a* when the engaging groove 731*a* is opened downward. This seizing portion 731*c* crosses the notched groove 723C of the cover plate 723 and stops while inclining upward gradually toward the deep side (outdoor side) of the notched groove 723C when the latch 731 is rotated clockwise as shown in FIG. 5A. Between the latch 731 and the latch case 722, a latch spring (not shown) is provided that always presses the latch 731 clockwise in FIGS. 5A to 5C.

The ratchet 732 is rotatably arranged at a position more indoors than the latch shaft 733 and lower than the notched groove 723C of the base plate 721 via a ratchet shaft 734 extending almost horizontally along the front and rear direction of the vehicle main body from the base plate 721, and includes an engaging portion 732*a* and an acting portion 732*b*.

The engaging portion 732*a* extends toward the outdoor side and away from the center of the ratchet shaft 734, and is capable of engaging with, via its projecting end face, the hook 731*b* and the seizing portion 731*c* of the latch 731 when the ratchet 732 rotates counterclockwise in FIG. 5A to 5C.

The acting portion 732*b* extends toward the indoor side and away from the center of the ratchet shaft 734. This ratchet 732 has a ratchet lever 735 that rotates around the center of axis of the ratchet shaft 734 integrally with the ratchet 732, at a position on the vehicle front side. The ratchet lever 735 is joined to the ratchet 732 by a joint pin 736. Between the ratchet 732 and the latch case 722, a ratchet spring (not shown) is provided that always presses the ratchet 732 counterclockwise in FIGS. 5A to 5C.

On the upper portion of the latch 731, a courtesy switch 737 that detects the position of the latch 731 is provided. The armature of the courtesy switch 737 comes into abrasive contact with a cam surface 731*d* formed on the outer circumferential surface of the latch 731 and separates from the cam surface 731*d* of the latch 731 to detect the latch position of the latch 731. Therefore, when a door opening operation is carried out, in the process of turning from a full-latching state to a half-latching state (immediately before turning into a half-latching state), the courtesy switch 737 is turned on, and when a door closing operation is carried out, the courtesy switch 737 is turned off in the process of turning from a half-latching state to a full-latching state (immediately before turning into a full-latching state). When the latch 731 is out of the full-latching position (when it is at an opening position or half-latching position), the indoor lamp (not shown) or the like of the vehicle is turned on.

The signal cable 737*a* connected to the courtesy switch 737 extends from the inside of the latch mechanism housing 720 and is nipped and held between the latch mechanism housing 720 and the lock mechanism housing. The signal cable 737*a* extends from the inside of the latch case 722 and is wired so as to be nipped and held between the latch case 722 and the circumferential wall 718B, and pressed by the claws 718Ba, 718Bb, and 718Bc so as not to bulge out between the latch case 722 and the circumferential wall 718B.

In the latch mechanism 730, when the door is opened from the vehicle main body, as shown in FIG. 5A, the latch 731 is arranged at an opening position and the indoor lamp of the vehicle is turned on. When the door is operated to close from this state, the striker S provided on the vehicle main body side enters the notched groove 723C of the cover plate 723 and the striker S eventually comes into contact with the seizing portion 731*c* of the latch 731. As a result, the latch 731 rotates counterclockwise in FIGS. 5A to 5C against an elastic force of a latch spring (not shown). During this rotation, the projecting end face of the engaging portion 732*a* of the ratchet 732 comes into abrasive contact with the outer circumferential surface of the latch 731 against the elastic force of the ratchet spring (not shown), and rotates around the center of axis of the ratchet shaft 734 according to the outer circumferential form of the latch 731.

When the door is further operated to close from this state, since the amount of the striker S entering the notched groove 723C of the cover plate 723 gradually increases, the latch 731 further rotates counterclockwise, and as shown in FIG. 5B, the engaging portion 732*a* of the ratchet 732 reaches the engaging groove 731*a* of the latch 731. In this state, the seizing portion 731*c* of the latch 731 comes into contact with the engaging portion 732*a* of the ratchet 732, so that the clockwise rotation of the latch 731 is blocked against the elastic returning force of the latch spring (not shown). In addition, since the hook 731*b* of the latch 731 is arranged across the notched groove 723C of the cover plate 723, the movement of the striker S to come out of the notched groove 723C of the cover plate 723, that is, the opening operation of the door with respect to the vehicle main body is prevented (half-latching state).

When the door D is further operated to close from the half-latching state, due to the striker S entering the notched groove 723C of the cover plate 723, the latch 731 further rotates counterclockwise via the seizing portion 731*c* and the striker S reaches the deep side (outdoor side) of the notched groove 723C of the cover plate 723. During this time, the ratchet 732 rotates clockwise in FIGS. 5A to 5C against the elastic force of the ratchet spring (not shown) due to contact of the hook 731*b* of the latch 731 with the upper surface of the engaging portion 732*a*, and starts rotating counterclockwise due to the elastic returning force of the ratchet spring (not shown) immediately when the hook 731*b* of the latch 731 passes over. As a result, as shown in FIG. 5C, since the hook 731*b* of the latch 731 comes into contact with the engaging portion 732*a* of the ratchet 732, the clockwise rotation of the latch 731 is blocked against the elastic returning force of the latch spring (not shown). In this state, the hook 731*b* of the latch 731 is also arranged across the notched groove 723C of the cover plate 723, the movement of the striker S to come out of the deep side (outdoor side) of the notched groove 723C of the cover plate 723 is prevented by the hook 731*b*, and as a result, the door closed state to the vehicle main body is maintained (full-latching state), and the indoor lamp of the vehicle is turned off.

From the full-latching state, when the acting portion 732*b* of the ratchet 732 or the ratchet lever 735 is rotated clockwise in FIGS. 5A to 5C against the elastic force of the ratchet spring (not shown), the contact engagement between the hook 731*b* of the latch 731 and the engaging portion 732*a* of the ratchet 732 is released, and the latch 731 rotates clockwise in FIGS. 5A to 5C due to the elastic returning force of the latch spring (not shown). As a result, as shown in FIG. 5A, the notched groove 723C of the cover plate 723 is opened, the striker S becomes movable in the direction of coming out of the notched groove 723C of the cover plate 723, the door becomes openable from the vehicle main body, and the indoor lamp of the vehicle is turned on.

In the door lock system according to the second embodiment, the lock mechanism housing 710 and the latch mechanism housing 720 are assembled and integrated with each other. In detail, the latch mechanism housing 720 is moved from the door rear side to the door front side and attached to the latch mechanism attaching portion 718 provided in the lock mechanism housing 710. At this point, the seizing portion 714Ab on the front end 714Aa of the shaft 714A in the outside handle lever 714 shown in FIG. 15 is inserted into and fitted to the concave portion 722A of the latch case 722 in the latch mechanism housing 720 shown in FIG. 15 and FIG. 16.

Then, the base plate 721 (surface with attaching holes 721Ca) of the latch mechanism housing 720 comes into contact with the casing 718A of the latch mechanism attaching portion 718 and the movement of the latch mechanism housing 720 to the door front side stops. Thereby, the positions of the open lever (not shown) provided inside the lock mechanism housing 710 and the ratchet lever 735 provided on the latch mechanism housing 720 side are fitted to each other. The open lever (not shown) interlocks when either one of the outside handle lever 714 or the inside handle lever 715 is operated, and the ratchet lever 735 is operated by this open lever (not shown). Namely, by inserting and fitting the seizing portion 714Ab of the shaft 714A to the concave portion 722A, the positions of the latch mechanism 730 and the lock mechanism are fitted to each other. Thus, the concave portion 722A and the seizing portion 714Ab of the shaft 714A serve as a positioning unit that fits the positions of the latch mechanism 730 and the lock mechanism to each other.

Then, when the seizing portion 714Ab of the shaft 714A is inserted and fitted to the concave portion 722A and the base plate 721 (surface with attaching holes 721Ca) of the latch mechanism housing 720 comes into contact with the casing 718A of the latch mechanism attaching portion 718 and stops the movement of the latch mechanism housing 720 to the door front side, as shown in FIG. 13, the latch case 722 in the latch mechanism housing 720 is fitted into the casing 718A of the latch mechanism attaching portion 718 so that the latch case is enclosed by the circumferential walls 718B and 718B' of the latch mechanism attaching portion 718. The latch case is fitted to the latch mechanism attaching portion 718 so that a part of the latch case 722 in the latch mechanism housing 720 and the indoor side plate 723B of the cover plate 723 close the opening 718C of the latch mechanism attaching portion 718. The base plate 721 (portion with the attaching screw hole 721Cb) and the cover plate 723 (portion with the attaching insertion hole 723E) sandwich the seizing piece 718D (portion with the attaching hole 718Da) on the opening edge of the opening 718C. Thereby, movements of the latch mechanism housing 720 to the upper side, the lower side, the outdoor side, and the indoor side are restricted by the circumferential walls 718B and 718B' and the seizing piece 718D. Namely, with respect to the lock mechanism housing 710 (the latch mechanism attaching portion 718), movements of the latch mechanism housing 720 in directions in which the seizing portion 714Ab of the shaft 714A comes out of the concave portion 722A other than the extending direction of the shaft 714A are restricted. Thus, the outer form of the latch mechanism housing 720 and the circumferential walls 718B and 718B', and the seizing piece 718D of the latch mechanism attaching portion 718 serve as a restricting unit that restricts relative movements of the lock mechanism housing 710 and the latch mechanism housing 720 in directions other than the extending direction of the shaft 714A when the seizing portion 714Ab of the shaft 714A is inserted and fitted to the concave portion 722A.

When the seizing portion 714Ab of the shaft 714A is inserted and fitted to the concave portion 722A and the base plate 721 (surface with the attaching screw hole 721Ca) of the latch mechanism housing 720 comes into contact with the casing 718A of the latch mechanism attaching portion 718 and stops the movement of the latch mechanism housing 720 to the door front side, the attaching screw hole 721Ca formed in the base plate 721 of the latch mechanism housing 720 communicate with the attaching hole 718Aa formed in the casing 718A. The attaching screw hole 721Cb communicates with an attaching hole 718Da formed in the seizing piece 718D by sandwiching the seizing piece 718D (portion with the attaching hole 718Da) on the opening edge of the opening 718C between the base plate (portion with the attaching screw hole 721Cb) and the cover plate 723 (portion with the attaching insertion hole 723E).

The signal cable 737*a* connected to the courtesy switch 737 is wired to be nipped and held between the latch mechanism housing 720 (latch case 722) and the circumferential wall 718B of the latch mechanism attaching portion 718. Namely, the signal cable 737*a* is laid along the right side surface of the latch case 722 and the latch mechanism housing 720 is attached to the latch mechanism attaching portion 718, Whereby the signal cable 737*a* is nipped and held between the latch mechanism attaching portion 718 and the latch mechanism housing 720.

Then, as shown in FIG. 13 and FIG. 14, the attaching screws 725 are inserted from the attaching holes 718Aa and 718Da and screwed into the attaching screw holes 721Ca and 721Cb, whereby a door lock system in which the lock mechanism housing 710 and the latch mechanism housing 720 are assembled and integrated with each other is obtained.

Thereafter, the door lock system is fixed to the door. In the surface of the rear side of the door to which the door lock system is fixed, a notched hole opened along the circumference of the notched groove 723C formed in the cover plate 723 of the latch mechanism housing 720 and bolt receiving holes opened according to the fixing insertion holes 723D are formed although these are not shown. In the surface of the indoor side of the door, an opening hole opened through the opening extended portion 710C provided on the main case 710A and a bolt receiving hole opened according to the female screw hole 717A formed in the fixing member 717 are formed although these are not shown. Then, the door lock system is arranged inside the door, fixing screws (not shown) are inserted from the outside of the bolt receiving hole, inserted through the fixing insertion holes 723D, and screwed into the fixing screw holes 721D. Thereby, the door lock system is fixed to the open end of the door on the door rear side via the latch mechanism housing 720 while the notched groove 723C matches the notched hole. Furthermore, a bolt (not shown) is inserted from the outside of the bolt receiving holes and screwed into the female screw hole 717A of the fixing member 717. Thereby, the lock mechanism housing 710 side of the door lock system is fixed to the door while the opening extended portion 710C projects from the opening hole.

When the lock mechanism housing 710 and the latch mechanism housing 720 are assembled together, the seizing portion 714Ab of the shaft 714A is fitted to the concave portion 722A to fit the positions of the latch mechanism and the lock mechanism, and then the outer form of the latch mechanism housing 720 is fitted to the inside of the circumferential walls 718B and 718B' of the latch mechanism attaching portion 718. Furthermore, the base plate 721 (portion with the attaching screw hole 721Cb) and the cover plate 723 (portion with the attaching insertion hole 723E) are put therein. Thereby, relative movements of the lock mechanism housing 710 and the latch mechanism housing 720 in directions other than the extending direction of the shaft 714A are restricted. As a result, when the latch mechanism and the lock mechanism are assembled together, the assembling work can be carried out efficiently.

The signal cable 737*a* connected to the courtesy switch 737 that comes into abrasive contact with the cam surface 731*d* formed on the latch to detect the latch position is extended from the inside of the latch mechanism housing 720 and nipped and held between the latch mechanism housing 720 and the lock mechanism housing 710, whereby the signal cable 737*a* can be wired neatly and the wiring work becomes easy.

In the door lock system according to the second embodiment, the positioning unit includes the seizing portion 714Ab of the shaft 714A in the outside handle lever 14 and the concave portion 22A of the latch mechanism housing 720, however, the shaft may support another lever or may not be a shaft supporting a lever.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door lock system comprising:

a housing;

a latch mechanism housed in said housing, including a latch and a ratchet for engaging with a striker formed on a separate body from said housing in order to maintain a closed state of a door to the separate body;

a lock mechanism housed in the housing, for disabling and enabling the latch mechanism, wherein the lock mechanism comprises:

an electrical unit including a drive motor that switches the lock mechanism between a locked state and an unlocked state, a first switch that is disposed below the drive motor and detects the locked state or the unlocked state of the lock mechanism, and a second switch that is disposed below the drive motor and detects the locked state or the unlocked state of the lock mechanism caused by an operation of the drive motor or an inside lock button;

an input portion disposed at a lower side of the housing than the electrical unit and the latch mechanism, including a key lever positioned on an input shaft for inputting a rotating drive force of a key cylinder in response to a key operation from outside of the housing to switch the lock mechanism between the unlocked state and the locked state, and a lock lever positioned on a rotation shaft for inputting the driving force of the inside lock button from outside of the housing, wherein the input shaft is disposed below the rotation shaft in the housing;

a key cylinder link unit including a link or cable configured to transmit the rotating drive force from the key cylinder to the input shaft; and a lock portion including a sector gear, a panic lever and a worm wheel, wherein the lock portion is housed inside the housing at a position higher than the input portion so that rain water is prevented from reaching the lock portion and the lock mechanism is prevented from malfunctioning; and a handle capable of moving between an open position and a close position, wherein the handle is connected to the lock mechanism via the input portion to transmit movement of the handle to the lock mechanism, wherein when the handle is in the open position the lock mechanism is switched through the input portion to the unlocked state and when the handle is in the close position the lock mechanism is switched through the input portion to the locked state, and a drain hole that drains water to outside of the housing is disposed at a bottom of the housing with the input shaft.

* * * * *